US011988065B2

(12) United States Patent
Martin et al.

(10) Patent No.: US 11,988,065 B2
(45) Date of Patent: May 21, 2024

(54) APPARATUS, SYSTEM AND PROCESS FOR REGULATING A CONTROL MECHANISM OF A WELL

(71) Applicant: Intelligent Wellhead Systems Inc., Calgary (CA)

(72) Inventors: Bradley Robert Martin, Red Deer (CA); Murad Mohammad, Calgary (CA); Sheldon Kryger, Calgary (CA); Robert Duncan, Calgary (CA)

(73) Assignee: Intelligent Wellhead Systems Inc., Calgary (CA)

( * ) Notice: Subject to any disclaimer, the term of this patent is extended or adjusted under 35 U.S.C. 154(b) by 0 days.

(21) Appl. No.: 18/347,398

(22) Filed: Jul. 5, 2023

(65) Prior Publication Data

US 2023/0349261 A1 Nov. 2, 2023

Related U.S. Application Data

(63) Continuation of application No. 17/877,327, filed on Jul. 29, 2022, which is a continuation of application No. 16/638,629, filed as application No. PCT/CA2019/050890 on Jun. 27, 2019, now Pat. No. 11,608,708.

(60) Provisional application No. 62/733,355, filed on Sep. 19, 2018.

(51) Int. Cl.
*E21B 34/02* (2006.01)

(52) U.S. Cl.
CPC ..... *E21B 34/025* (2020.05); *E21B 34/02* (2013.01)

(58) Field of Classification Search
CPC ..... E21B 34/02; E21B 34/025; E21B 17/04; E21B 33/061; E21B 34/04; E21B 34/10; E21B 34/16; E21B 47/04; E21B 47/085; E21B 47/092
See application file for complete search history.

(56) References Cited

U.S. PATENT DOCUMENTS 3,856,037 A * 12/1974 Garrett ..... E21B 34/02 137/637.1
6,154,704 A * 11/2000 Jericevic ..... E21B 47/04 702/6

(Continued)

*Primary Examiner* — Daniel P Stephenson
(74) *Attorney, Agent, or Firm* — Osha Bergman Watanabe & Burton LLP

(57) ABSTRACT

A wellhead apparatus comprising a first part that is mountable to a portion of a wellhead or proximal to the wellhead and a second part that is mountable to a component of wellhead operation equipment, wherein the component is operatively connectible to the wellhead, wherein the wellhead identifier generates an identifier signal when the first part is proximal the second part and is receivable by a user to identify the wellhead from a plurality of wellheads when the wellhead and the component are operatively connected. A wellhead identifier system comprising a detectable signal generator mountable to a component of wellhead operation equipment, a sensor configured to detect the detectable signal for generating object-based sensory information, and a controller circuit for receiving the object-based sensory information and for identifying a wellhead on a well pad where a wellhead operation has or will commence on the wellhead.

14 Claims, 24 Drawing Sheets

(56) References Cited

U.S. PATENT DOCUMENTS 6,550,368 B2 * 4/2003 Leeman ..... F15B 11/20 137/637.1
9,080,411 B1 * 7/2015 Lugo ..... E21B 33/064
9,097,813 B2 * 8/2015 Carlson ..... E21B 33/061
10,954,737 B1 * 3/2021 Nouh ..... E21B 17/01
11,274,520 B2 * 3/2022 Martin ..... E21B 47/06
11,708,738 B2 * 7/2023 Olson ..... F04B 23/02 251/1.3
2006/0169464 A1 * 8/2006 Richards ..... E21B 43/045 166/332.8
2008/0190623 A1 * 8/2008 Mailand ..... E21B 34/10 166/375
2011/0061861 A1 * 3/2011 Flanders ..... E21B 43/128 166/250.01
2011/0308619 A1 * 12/2011 Martino ..... F16K 3/0254 251/65
2012/0073670 A1 * 3/2012 Lymberopoulos ..... F16K 31/42 137/2
2012/0227983 A1 * 9/2012 Lymberopoulos ..... F16K 31/1262 166/373
2015/0308253 A1 * 10/2015 Clark ..... E21B 33/02 175/24
2016/0201838 A1 * 7/2016 Flanders ..... F16L 55/07 137/12
2016/0265300 A1 * 9/2016 Affleck ..... E21B 47/07
2018/0094747 A1 * 4/2018 Dordoni ..... F16K 31/535
2018/0298746 A1 * 10/2018 Short ..... E21B 47/04
2019/0186226 A1 * 6/2019 Beason ..... E21B 34/02
2019/0219186 A1 * 7/2019 Fink ..... F16K 17/0473
2019/0360295 A1 * 11/2019 Mantri ..... E21B 33/0355
2020/0011168 A1 * 1/2020 Chen ..... E21B 47/09
2020/0102893 A1 * 4/2020 Berry ..... F16K 37/0041
2021/0363856 A1 * 11/2021 Martin ..... E21B 43/2607
2022/0205337 A1 * 6/2022 Martin ..... E21B 33/03
2022/0316307 A1 * 10/2022 Curry ..... E21B 43/2607
2022/0397016 A1 * 12/2022 Martin ..... E21B 43/2607
2023/0184049 A1 * 6/2023 Cunningham ..... E21B 47/12 166/244.1
2023/0193742 A1 * 6/2023 Mammadov ..... E21B 44/06 166/250.15
2023/0203901 A1 * 6/2023 Thomson ..... E21B 23/001 166/381

* cited by examiner

APPARATUS, SYSTEM AND PROCESS FOR REGULATING A CONTROL MECHANISM OF A WELL

TECHNICAL FIELD

This disclosure generally relates to production of hydrocarbons at a well site and/or well pad. In particular, the disclosure relates to an apparatus, system and process for regulating a control mechanism of a well.

BACKGROUND

Petroleum hydrocarbon fluids are often recovered from wells that provide fluid communication between a subterranean formation and a wellhead at the surface. In an effort to increase efficiency and decrease the costs associated with exploring, drilling, servicing and producing from an individual well, many wellheads can be located on a single well pad. However, each well can have different operational requirements at a given time. The number of wells that are developed on a particular pad can result in the well pad becoming a complicated and busy place with many different well service companies performing different well operations at different times on different wells. A complicated and busy well pad can result in miscommunication, which in turn can result in mistakes and accidents occurring.

SUMMARY

The embodiments of the present disclosure relate to an apparatus, system and process for regulating the position of one or more wellhead control mechanism, such as a wellhead valve, on a well pad. Some embodiments of the present disclosure provide a user the ability to indirectly control the position of a wellhead control mechanism, which may be referred to herein as indirect control or interlock. Indirect control will ultimately require a user to physically actuate an actuator of a wellhead control mechanism, for example move a lever, toggle a switch and/or push a button so that the wellhead control mechanism changes position. Some embodiments of the present disclosure provide a user the ability to directly control the position of a wellhead control mechanism, which may be referred to herein as direct control. Direct control will not ultimately require a user to physically actuate an actuator of a wellhead control mechanism because the user can directly and, optionally remotely, actuate the wellhead control mechanism, for example through a controller circuit. Some embodiments of the present disclosure relate to different ways for collecting information about the operational state of one or more wells of a well pad and using that information to regulate the position of one or more wellhead control mechanisms. Various sensors, and various types of sensors, may be used to collect information that allows a user to assess whether or not it is safe to actuate one or more wellhead control mechanisms.

Some embodiments of the present disclosure relate to a valve-position regulator apparatus for regulating a position of a wellhead control mechanism through indirect control. The apparatus comprises a frame that is operatively connectible to an actuator for the wellhead valve, wherein the actuator controls whether the wellhead valve is in an open position, a closed position or therebetween. The apparatus also comprises a moveable body that is configured to move between a first position and a second position and the wellhead valve position can be changed. When the moveable body is in the first position the actuator is actuatable and when the moveable body is in the second position the actuator is physically interfered from actuating and the wellhead valve position cannot change.

Some embodiments of the present disclosure relate to a system for regulating a wellhead control mechanism. The system comprises a valve position regulator and a valve actuation panel. The valve position regulator is configured to move between a first position and a second position for physically interfering with actuation of the control mechanism. The valve actuation panel receives power from a power source and that comprises an actuator that is configured to regulate the flow of power to the valve position regulator for moving the valve position regulator between the first position and the second position.

Some embodiments of the present disclosure relate to a system for regulating a wellhead control mechanism. The system comprises an actuator system and a controller circuit. The actuator system is configured to directly actuate the wellhead control mechanism and the controller circuit that is operatively connected to the actuator system and the controller circuit is configured for sending regulatory commands to the actuator system.

Some embodiments of the present disclosure relate to a process for regulating one or more wellhead valves through indirect control. The process comprises the steps of receiving one or more of fluid-based information, object-based information or valve-position information; and assessing whether it is desirable to lock or unlock a regulator of an actuator of a wellhead valve in order to avoid an accident.

Some embodiments of the present disclosure relate to a valve-position regulator apparatus and system for regulating a position of a wellhead control mechanism through direct control. This apparatus comprises at least one mechanism that can directly change the position of the wellhead control mechanism without requiring any further steps to change the position.

Some embodiments of the present disclosure relate to a process for regulating the position of a wellhead control mechanism through direct control. The process comprises at least one step of directly changing the position of a wellhead control mechanism. Other processes comprise at least one step of indirectly changing the position of a wellhead control mechanism through indirect control.

Some embodiments of the present disclosure relate to a process for regulating a wellhead control mechanism. The process comprises the steps of: receiving fluid-based information or object-based information; and assessing whether the wellhead control mechanism can be actuated.

Some embodiments of the present disclosure relate to a process for regulating a wellhead control mechanism. The process comprising the steps of: locking out the wellhead control mechanism so that it cannot actuate; and performing a handshake protocol to determine if the locked out wellhead control mechanism can be released and then actuated.

Some embodiments of the present disclosure relate to a process for regulating the position of a wellhead control mechanism through direct control. The process comprises at least one step of directly changing the position of a wellhead control mechanism. Other processes comprise at least one step of indirectly changing the position of a wellhead control mechanism through indirect control.

Without being bound by any particular theory, the embodiments of the present disclosure provide one or more operators at a wellhead or a well pad an apparatus, system and process by which the actuation of a wellhead control mechanism, such as a wellhead valve, can be regulated.

Regulating the actuation of a wellhead control mechanism at one or more wellheads may help avoid accidents at the well site and/or well pad. Examples of such accidents can include when a wellhead valve is opened or closed at the incorrect time while an operation is being performed on a wellhead. For example, in some embodiments of the present disclosure the apparatus provides a physical interference that requires a valve operator to take at least one extra step to ensure that it is safe to actuate a given valve at a given time during a well operation. In some embodiments of the present disclosure, information about what is happening at, within or near the wellhead provides the valve operator further information to ensure that it is safe to actuate a given wellhead valve at a given time during a well operation. In scenarios where there are multiple operations occurring on a given well pad, some embodiments of the present disclosure allow for information from one or more wellheads to be provided to one user or multiple users to avoid an unsafe actuation of a given wellhead control mechanism, on a given wellhead at a given time. An unsafe actuation of a wellhead control mechanism may cause a wellhead valve to close on wireline, coiled tubing or some other downhole tool, which can lead to expensive downtime and fishing operations. An unsafe actuation of a wellhead control mechanism can also occur when there is a high pressure-differential across a closed wellhead valve and when there is a high-pressure fluid flow through an open wellhead valve, both of which can occur during a well operation, such as fracking. An unsafe actuation of a wellhead control mechanism during a well operation can allow high-pressure fluid to escape pressure containment means and/or damage the conduit infrastructure of the well site and/or well pad and put personnel at risk. The unsafe actuation of a wellhead control mechanism may be avoided by the apparatus, systems and processes of the present disclosure by locking a given wellhead valve in a position until such time that one or more verification steps can be taken to ensure that it is safe to actuate the valve. The actuating of the wellhead control mechanism, either at the wellhead or elsewhere on the well pad, in a given position can comprise physically interfering with the actuation of a valve, or by remotely actuating the valve by a pneumatic, hydraulic or electronic system. In some embodiments of the present disclosure, the actuation of the wellhead control mechanism can be automated via a controller circuit and an optional handshake protocol.

Some embodiments of the present disclosure relate to a position regulator apparatus for regulating a position of a wellhead control mechanism whereby changing the position of the wellhead control mechanism controls the flow of fluids through, to or from a wellhead; opens or closes a fluid flow path through, to or from a section of a wellhead; and, provides pressure containment between two or more sections of a wellhead.

The apparatus comprises: a frame that is operatively connectible to an actuator for the valve, wherein the actuator controls whether the valve is in an open position, a closed position or therebetween; and a moveable body that is configured to move between a first position and a second position, when the moveable body is in the first position the actuator is actuatable and when the moveable body is in the second position the actuator is physically interfered from actuating.

In some embodiments of the present disclosure the moveable body is an elongate body that is configured for physically interfering with the actuator by extending into the second position and blocking actuation of at least one portion of the actuator.

In some embodiments of the present disclosure the moveable body is a cover for physically interfering with the actuator by moving into the second position and overlaying the control mechanism.

Some embodiments of the present disclosure relate to a system for regulating the position of a wellhead control mechanism. The system comprises an apparatus that comprises: a frame that is connectible to an actuator for the valve, wherein the actuator controls whether the valve is in an open position, a closed position or therebetween; and a moveable body that is configured to move between a first position and a second position, when the moveable body is in the first position the actuator is actuatable and when the moveable body is in the second position the actuator is physically interfered from actuating; and an actuating system that is configured for moving the moveable body between the first position and the second position.

In some embodiments of the present disclosure the actuating system is one of a pneumatic-based actuating system, a hydraulic-based actuating system, an electronic-based actuating system and a combination thereof.

In some embodiments of the present disclosure the system further comprises a sensor that is configured for detecting a first condition within the well head and for generating a condition-based information signal.

In some embodiments of the present disclosure the sensor is a pressure-sensor and the first condition is the fluid pressure within a conduit that is in fluid communication with the wellhead and the condition-based information signal is a fluid-based information signal.

In some embodiments of the present disclosure the sensor is a sensor assembly that is configured to detect a presence of an object within a portion of the well head and the condition-based information signal is an object-based information signal.

In some embodiments of the present disclosure the sensor is a sensor assembly that is configured to detect a position of a wellhead control mechanism and the condition-based information signal is a position-based information signal.

In some embodiments of the present disclosure the sensor assembly comprises a magnetic field generator and a magnetic sensor.

In some embodiments of the present disclosure the system further comprises a detectable signal generator that is affixable to an object that is passable through the wellhead and wherein the sensor assembly is configured to detect a detectable signal generated by the detectable signal generator.

In some embodiments of the present disclosure the system further comprises a detectable signal generator that is affixable to a section of the wellhead and wherein the sensor assembly is affixable to an object that is passable through the wellhead and the sensor assembly is configured to detect a detectable signal generated by the detectable signal generator.

In some embodiments of the present disclosure the sensor is a position sensor that is configured to detect a position of a valve that regulates the flow of fluids through, to or from the wellhead and the condition-based information is a position based information signal.

In some embodiments of the present disclosure the system further comprises a controller circuit for receiving the conditions-based information signal and for generating and sending a display command to a user interface that represents the condition-based information signal.

In some embodiments of the present disclosure the controller circuit also generates a valve-position regulator command for actuating the moveable body between the first position and the second position and vice versa.

Some embodiments of the present disclosure relate to a process for regulating a wellhead control mechanism. The process comprises the steps of: receiving one or more of fluid-based information, object-based information or position-based information; and assessing whether a valve proximal the wellhead can be locked or unlocked.

In some embodiments of the present disclosure the process further comprises a step of locking the wellhead control mechanism.

In some embodiments of the present disclosure the process further comprises a step of meeting the requirements of a handshake protocol before any step that changes the position of the wellhead control mechanism.

Some embodiments of the present disclosure relate to another system for regulating a wellhead control mechanism. The system comprises: a valve position regulator that is configured to move between a first position and a second position for physically interfering with actuation of the control mechanism; a valve actuation panel that receives power from a power source and that comprises a valve that is configured to regulate the flow of power to the valve position regulator for moving the valve position regulator between the first position and the second position.

In some embodiments of the present disclosure the system further comprises one or more conduits for communicating the power from the power source to the valve actuation panel and for communicating the power from the valve actuation panel to the valve position regulator.

In some embodiments of the present disclosure the power source is one of a hydraulic power source, a pneumatic power source, an electronic power source or a combination thereof.

In some embodiments of the present disclosure the system further comprises a controller circuit for controlling a position of the valve of the valve actuation panel for regulating the flow of power to the valve position regulator.

In some embodiments of the present disclosure the system further comprises a sensor that is configured to send object-based information to the controller circuit for regulating the flow of power to the valve position regulator.

In some embodiments of the present disclosure the system further comprises a further sensor that is configured to send fluid-based information to the controller circuit for regulating the flow of power to the valve position regulator.

In some embodiments of the present disclosure the fluid-based information is pressure-based information or flow-based information.

In some embodiments of the present disclosure the system further comprises a user interface device that is operatively communicatable with the controller circuit.

Some embodiments of the present disclosure relate to another system for regulating a wellhead control mechanism. The system comprises: an actuator system that is configured to directly actuate the wellhead control mechanism; and a controller circuit that is operatively connected to the actuator system and the controller circuit is configured for sending regulatory commands to the actuator system.

In some embodiments of the present disclosure the system further comprises a user interface that is operatively communicatable with the controller circuit.

In some embodiments of the present disclosure the system further comprises one or more sensors that are configured for providing object-based information to the controller circuit and/or the user interface.

In some embodiments of the present disclosure the system further comprises one or more sensors that are configured for providing position-based information to the controller circuit and/or the user interface.

In some embodiments of the present disclosure the actuator system comprises an electronic actuator that is operatively coupled to the wellhead control mechanism for actuating the wellhead control mechanism.

In some embodiments of the present disclosure the actuator system comprises a valve panel and the valve panel comprises a valve that is actuatable under direction of the controller circuit so that when the valve is open, a power fluid can actuate the wellhead control mechanism and when the valve is closed the wellhead control mechanism is locked in a position.

In some embodiments of the present disclosure the power fluid is either a hydraulic power-fluid or a pneumatic power-fluid.

In some embodiments of the present disclosure the wellhead control mechanism is one or more of: a swab valve, a pump-down valve, an hydraulic master-valve, a side port valves, a zipper manifold valve, a flow-back valve, a pump-down valve and a blowout preventer.

BRIEF DESCRIPTION OF THE DRAWINGS

These and other features of the present disclosure will become more apparent in the following detailed description in which reference is made to the appended drawings.

FIGS. 2A/B shows an example of a first valve-position regulator mechanism, according to embodiments of the present disclosure, for use with a lever valve, wherein FIG. 2A shows an isometric view of the first valve-position regulator mechanism that is operatively connected to a lever valve; and, FIG. 2B shows an exploded, isometric view of the first valve-position regulator mechanism;

FIGS. 3A/B shows an example of a second valve-position regulator mechanism, according to embodiments of the present disclosure, for use with a wheel valve, wherein FIG. 3A shows an isometric view of the second valve-position regulator mechanism that is operatively coupled to a wheel valve; and, FIG. 3B shows an exploded, side elevation-view of the second valve-position regulator mechanism;

FIGS. 4A/B/C shows an example of a third valve-position regulator mechanism, according to embodiments of the present disclosure, for use with a button-controlled valve control and/or with a switch-controlled valve control, wherein FIG. 4A shows an isometric view of the third valve-position regulator mechanism in a locked position.

FIGS. 5A/B shows an example of a wellhead identifier, according to embodiments of the present disclosure, for use with a wellhead on a well pad, wherein FIG. 5A shows an isometric view of the wellhead identifier operatively connected to a mounting frame; and, FIG. 5B shows an exploded, isometric view of the wellhead identifier;

FIGS. 7A/B shows a connector for use with a mounting bracket, according to embodiments of the present disclosure, wherein FIG. 7A is an exploded, side-elevation view of the connector and mounting bracket; and, FIG. 7B is an exploded isometric view of the connector and mounting bracket;

FIGS. 8A/B shows the sensor array of FIG. 6 supported by the mounting bracket and the connector of FIGS. 7A/B, wherein FIG. 8A shows the wellhead-mountable sensor in an open position; and, FIG. 8B shows the well-mountable sensor in a closed position;

FIGS. 12A/B are two examples of a schematic that represents other embodiments of the present disclosure for regulating a one or more wellhead control mechanisms of one or more wellheads, wherein FIG. 12A shows one embodiment.

FIGS. 13A/B are two examples of a schematic that represents other embodiments of the present disclosure for regulating one or more wellhead control mechanisms of one or more wellheads, wherein FIG. 13A shows one embodiment.

FIGS. 17A/B shows an example of a schematic that represents a hardware structure and a process logic-flow, according to embodiments of the present disclosure, for moving a valve-position regulator mechanism between a locked position and an unlocked position, wherein FIG. 17A shows an example of a hardware structure; and, FIG. 17B shows an example of a process logic-flow for regulating a control mechanism on a single well;

FIGS. 18A/B shows an example of a schematic that represents an example of a system, according to embodiments of the present disclosure, for moving a valve-position regulator mechanism between the locked position and the unlocked position, wherein FIG. 18A shows an example of the structure of the system.

FIGS. 19A/B/C/D each show a schematic that represents examples of processes, according to embodiments of the present disclosure, for moving a valve-position regulator mechanism between the locked position and the unlocked position, wherein FIG. 19A shows an example of steps in a process that relate to a controller of the lockout mechanism.

DETAILED DESCRIPTION

Figure 1:
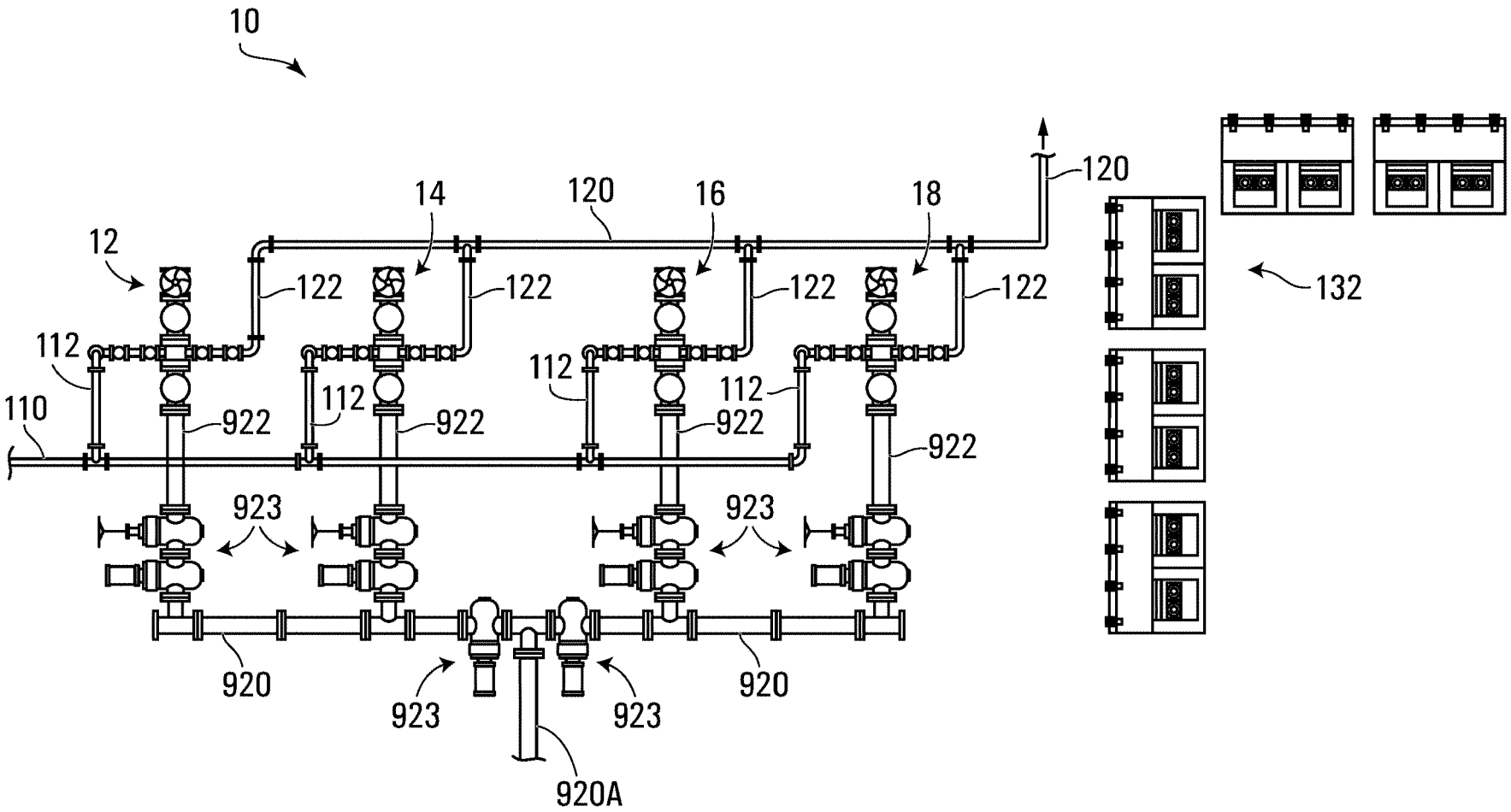
FIG. 1 is a schematic of an example of a well pad that includes four wellheads.

The embodiments of the present disclosure relate to an apparatus, a system and a process for regulating a control mechanism of a well for producing petroleum hydrocarbon fluids, such as liquids, gases and combinations thereof. The well provides fluid communication between a subterranean formation and the surface where a wellhead section of the well is located. The wellhead can be located on land or on an offshore platform. The subterranean formation is a source of hydrocarbon fluids, which can flow up the well to be produced at the wellhead. A number of different control mechanisms regulate the flow of the hydrocarbon fluids through the well. For example, a series of valves within the well can open and close for controlling the flow of hydrocarbon fluids through different sections of the well. Primarily, valves positioned on, in or proximal to the wellhead are used to control the flow of hydrocarbons and other fluids through, into or out of the wellhead. The position of each valve is controlled by a valve actuator. Some valve actuators may be positioned on the wellhead for direct control of a valve and some valve actuators may be positioned remotely from the wellhead for indirect control of a valve. Valve actuators can control the operational position of a valve through one or more of manual, hydraulic, pneumatic or electronically actuated control mechanisms.

Some embodiments of the present disclosure relate to an apparatus that is configured to control actuation of a wellhead valve by moving a moveable body of the apparatus between a first position and a second position. When the apparatus is in the first position the valve actuator is actuatable (i.e. unlocked) and actuating the valve actuator will make it possible to change the position of the wellhead valve by a further step. When the apparatus is in the second position the valve actuator is physically interfered from actuating (i.e., locked) by the moveable body. When the apparatus is in the second position, the valve actuator is locked, the wellhead valve cannot be actuated and the valve is held in an open position, a partially open position or a closed position.

Some embodiments of the present disclosure relate to a system that comprises a valve-position regulator apparatus and an actuation system. The actuation system is configured to actuate the apparatus between a first position and a second position, when in the first position the valve actuator is actuatable (i.e., unlocked) and when the apparatus is in the second position the valve actuator is physically interfered from actuating (i.e., locked). When the apparatus is in the second position, the valve actuator is locked, the valve cannot be actuated and the valve is held in either an open position, a partially open position or a closed position.

In some embodiments of the present disclosure, the system further comprises one or more sensors for providing fluid-based information, object-based information, valve-position information or combinations thereof. This information can be used to allow a user to determine when the valve-regulator apparatus that controls actuation of a wellhead valve can be moved between the first position and the second position, in either direction. In some embodiments of the present disclosure, the one or more sensors can send information to a controller circuit that can be a computing device, such as a server computer or a client controller circuit. The controller circuit can send display commands to a computing device with a user display to allow the user to visualize the information from the one or more sensors. In some embodiments of the present disclosure, the controller circuit can also send actuation commands to one or more valve actuator control systems to move the moveable body between the first position and the second position to change the flow of fluids through, to or from a desired wellhead.

Some embodiments of the present disclosure relate to a system that comprises an apparatus and an actuation system. The apparatus is configured to control actuation of a valve by physically interfering with movement of a valve actuator. The actuation system is configured to actuate the apparatus between a first position and a second position, when in the first position the valve actuator is actuatable (i.e., unlocked) and when the apparatus is in the second position the valve actuator is physically interfered from actuating (i.e., locked). When the apparatus is in the second position, the valve actuator is locked, the valve cannot be actuated and the valve is held in either an open position, a partially open position or a closed position.

Some embodiments of the present disclosure relate to a system that comprises an actuation system and one or more sensors for providing fluid-based information, object-based information or combinations thereof. The system may also comprise an actuation system that is configured to actuate one more valves between an open position and a closed position to regulate the flow of fluids through, to or from a wellhead. In some embodiments of the present disclosure, the one or more valves may all be moved together between the open position and the closed position at the same time or the actuation system may move the one or more valves be moved independently of each other. The information from the one or more sensors can be used to allow a user or a controller circuit to determine when the valve can be moved between the open position and the closed position and vice versa. In some embodiments of the present disclosure, the one or more sensors can send information to a controller circuit that can be a computing device, such as a server computer or a client controller circuit. The controller circuit can send display commands to a computing device with a user display to allow the user to visualize the information from the one or more sensors. In some embodiments of the present disclosure, the controller circuit can also send actuation commands to the actuator systems to move the valve between the open position and the closed position to change the flow of fluids through, to or from a wellhead.

Unless defined otherwise, all technical and scientific terms used herein have the same meaning as commonly understood by one of ordinary skill in the art to which this disclosure belongs.

As used herein, the term "about" refers to an approximately +/−10% variation from a given value. It is understood that such a variation is always included in any given value provided herein, whether or not it is specifically referred to.

As used herein, the term "accumulator" refers to equipment on a wellsite that is used for closing valves and blowout preventers. Accumulators typically have four components: a hydraulic pump, a hydraulic tank, accumulator bottles for storing hydraulic energy and valves for regulating the hydraulic equipment. An accumulator may also be referred to as a closing station or a closing unit.

As used herein, the term "barksdale" refers to a type of valve on an accumulator that is a rotatable hydraulic shear valve designed for minimal leakage.

As used herein, the term "blowout preventer" or "BOP" refers to one or more valves that form part of the Christmas tree and that are used to provide control of fluid flow from the well.

As used herein, the term "Christmas tree" refers to an assembly of valves, gauges and chokes, including one or more blow out preventers, which are part of a wellhead that forms an above-surface portion of a well, the Christmas tree can be used to control the flow of fluids through, to or from the well, to control pressure between different sections of the wellhead and it may include a frac head and/or frac tree.

As used herein, the term "conduit" refers to a physical structure that can conduct and/or communicate one or more of fluid, pressure, electrical power, electrical signals/commands or combinations thereof from one position to another position. Some non-limiting examples of such conduits include a pipe, a tube, a wire, a line or a cable.

As used herein, the term "consultant" refers to a representative of an exploration-and-producing oil company who is present at the well pad and duly authorized to make procedural decisions about operations at the well pad.

As used herein, the term "flow-back line" refers to a fluid conduit that is used to communicate fluids from one or more wellheads to one or more separators.

As used herein, the term "frac", which may be used interchangeably with "frack" and "hydraulic fracture", refers to a process that introduces high-pressure fluids into a surface portion of a well for flowing into a subterranean formation. The subterranean formation contains, or is in proximity to, a source of hydrocarbon fluids and the high-pressure fluids are of sufficiently high pressure to fracture—and thereby increase the permeability of—the subterranean formation. The increased permeability of the subterranean formation can allow for increased production of the hydrocarbon fluids through the well and back to the surface.

As used herein, the term "hydraulic latch assembly" refers to a remote locking device that is used for connecting wireline to a well while allowing workers to remain a safe distance from hazardous areas of the wellsite.

As used herein, the term "hydraulic power unit" or "HPU" is wellsite equipment that is used for providing pressurized hydraulic fluid/oil for moving hydraulic equipment. Hydraulic power units are powered by internal combustion engines, electric engines or other types of engines.

As used herein, the term "lock out" refers to an apparatus and/or system that is used to regulate the actuation (opening and closing) of a wellhead control mechanism for regulating the flow of fluids and/or pressure through, to and from a wellhead.

As used herein, the term "lubricator" refers to a section of high-pressure tubular that is connected to the top of a blow-out preventer, the lubricator includes a pressure control mechanism that allows a downhole tool to be introduced into a pressurized portion of a wellhead.

As used herein, the term "pump down" refers to the use of a fluid pump to communicate fluids from surface to down a well for facilitating the movement of wireline-deployed downhole tools downhole, often times through a non-vertical portion of a well.

As used herein, the term "pump-down line" refers to a fluid conduit that is used to communicate fluids from a pump-down pump to a wellhead.

As used herein, the term "slickline" refers to a steel version of wireline that may or may not be magnetic and that provides mechanical control of a downhole tool that is deployed in a well but it typically does not include conductive wires for electronic data transmission.

As used herein, the term "wellhead" refers to the equipment and components present at the surface end of a well that include a Christmas tree and that at least partially provides physical support to the well below the surface end.

As used herein, the term "well operation" refers to any operation that occurs on a well site or well pad including, but not limited to: a well drilling program, a well-stimulation operation, a well work-over operation, a fishing operation, a coiled-tubing operation, a wireline operation, a slickline operation, a braided-wire operation, a well-logging operation, a perforating operation, a fracking operation, a well maintenance operation, a wellhead maintenance operations, a pumping operation, a well-kill operation, a well shut-in operation, an oil and/or gas production operation, and combinations thereof.

As used herein, the term "wellhead control mechanism" refers to any mechanism, such as a wellhead valve, a BOP, a choke, a zipper manifold valve or otherwise, that can actuate for: regulating the flow of a fluid through, to or from a section of a wellhead; opening or closing a fluid flow path through, to or from a section of a wellhead; and providing pressure containment between two or more sections of a wellhead.

As used herein, the term "wellhead technician" refers to an individual person who actuates the valves on a well-site, whether the valves are hydraulically actuated or manually actuated.

As used herein the term "wellhead valve" refers to any valve positioned on or proximal to a wellhead for regulating the flow of fluids and/or pressure through, to or from a section of a wellhead.

As used herein, the term "well pad" refers to a physical location in proximity to one or more geological formations and where well operations are occurring on two or more oil and/or gas wells. For the purposes of this disclosure, the term "well pad" may also refer to a "well site" which is a physical location where only a single well is being operated on and it is understood that a well pad may be positioned upon a surface of the ground or a surface of an offshore platform.

As used herein, the term "wireline" refers to a cable that is supported on surface and is used to deploy tools (such as perforating guns, logging tools, plugs and the like) down into and up out of a well bore. Wireline can provide mechanical control over a downhole tool that is deployed in a well. Wireline can also conduct electrical signals between the surface and a downhole tool that is deployed in a well.

As used herein, the term "wireline supervisor" refers to an individual who oversees wireline operations.

As used here, the term "zipper manifold" refers to a manifold that is used for conducting and directing high-pressure, hydraulic fracturing fluid from a source into one or more wells on a multi-well pad. Zipper manifolds can include hydraulically actuated or manually actuated valves that regulate the fluid flow within the manifold. Zipper manifold may also be used interchangeably with the terms "frack line" or "trunk line".

Embodiments of the present disclosure will now be described by reference to FIG. 1 to FIG. 21.

FIG. 1 shows one example of a well pad 10 that includes four wells, each indicated by a wellhead 12, 14, 16 and 18 respectively. Each wellhead 12, 14, 16 and 18 is fluidly connected to a fracturing zipper manifold 920 that is in fluid communication with one or more high pressure fluid pumps (not shown) by a pump conduit 920A. The zipper manifold 920 is in fluid communication with each wellhead 12, 14, 16, 18 by one or more input conduits 922. The flow of fluids to each wellhead 12, 14, 16, 18 from the zipper manifold 920 is controlled by a series of zipper manifold valves 923.

Each wellhead 12, 14, 16, 18 is also in fluid communication with a pump-down conduit 110 by conduits 112. The pump-down conduit 110 provides pressurized fluids for pumping various tools down the wellheads 12, 14, 16, 18 such as coiled-tubing associated tools, wireline associated tools and the like.

Each wellhead 12, 14, 16, 18 is also in fluid communication with a flow-back line 120 by flow-back conduits 122. The flow-back line 120 carries fluid flow back from the wellhead 12, 14, 16, 18 to one or more separators, for example, following a fracking operation.

At each point that a conduit 922, 112, 122 fluidly connects to the wellhead 12, 14, 16, 18 there is a wellhead control mechanism, such as a wellhead valve, that controls the fluid communication across that connection point. Typically, these wellhead valves, including the zipper manifold valves 923, are hydraulically actuated under the control of an accumulator 132 (for clarity, the conduits that operatively connect the accumulator 132 to each valve are not shown in FIG. 1). The accumulator 132 comprises a number of valve actuators that control the flow of hydraulic fluid to and from the accumulator 132 to each wellhead valve. The accumulator 132 is typically powered by a hydraulic power unit (not shown).

At some well pads, the wellhead valves may be manually actuated, hydraulically pneumatically actuated or actuated by one or more electronic motors. In these well pads, there may not be a need for an accumulator 132 but there will still be actuators positioned about the well pad 10 that controls the actuation of each of the valves and the zipper manifold valves 923.

Figure 2A:
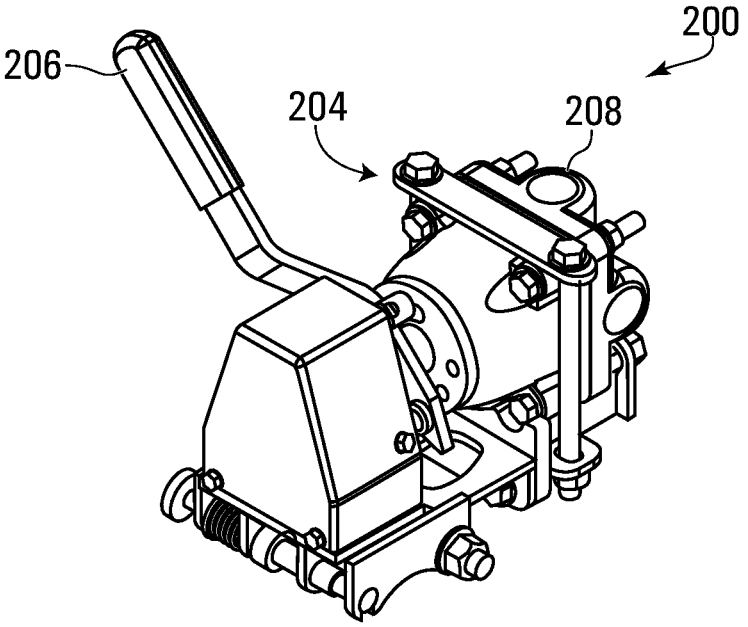
Figure 2B:
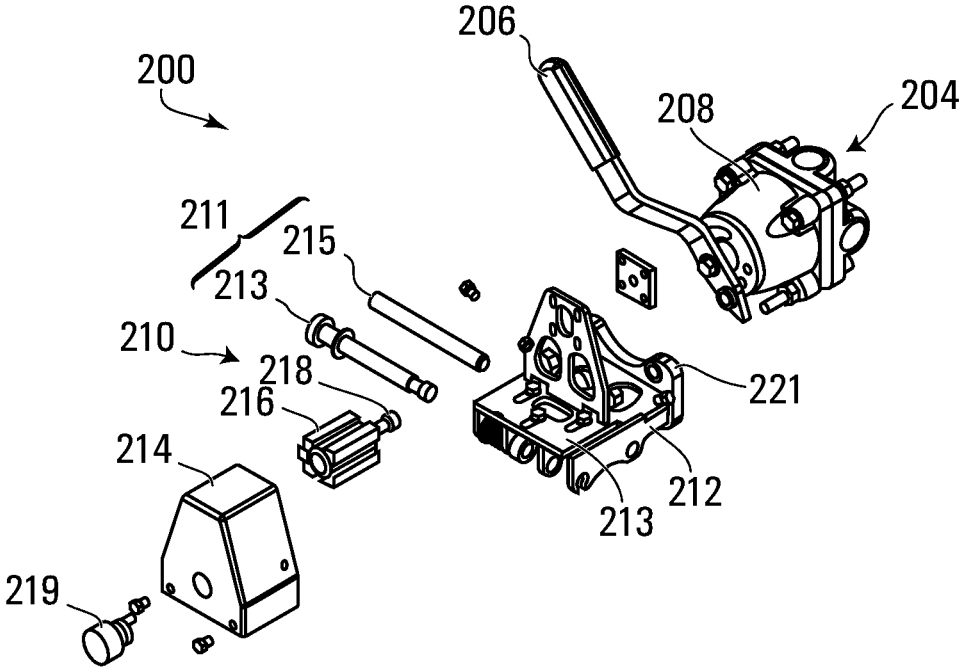

FIGS. 2A and 2B shows one example of a valve assembly 200 that comprises a lever valve 204 and a valve-position regulator 210. In the non-limiting example of FIGS. 2A and 2B, the lever valve 204 includes an actuator 206 and a valve body 208. The actuator 206 shown in FIGS. 2A and 2B is a lever arm that can be actuated between a first position and a second position in order to open or close a wellhead valve (not shown) that may be positioned within the valve body 208 or the wellhead valve may be positioned remotely from the valve body 208. For example, the wellhead valve may be a ball valve and movement of the actuator 206 can move the ball valve to permit, restrict or stop the flow of fluids through the valve. As will be appreciated by those skilled in the art, the wellhead valve can be any other type of valve including, but not limited to: a butterfly valve, a gate valve, a disc and stem valve or any other type of valve that can be actuated by an actuator 206 such as a valve arm.

The valve body 208 can be fluidly connected with an accumulator 132 or directly upon a wellhead or any fluid conduit that communicates fluids through, to or from a wellhead valve. Actuation of the actuator 206 will permit, restrict or stop at least a portion of the fluids from flowing through, to or from a wellhead valve.

The skilled person will appreciate that in some embodiments of the present disclosure, the valve body 208 may also control electronic signals (rather than fluid flow) that are sent to a wellhead valve so that actuation of the actuator 206 results in remote actuation of the wellhead valve.

As shown in FIG. 2B, the valve-position regulator 210 is configured to physically interfere with movement of the actuator 206. This physical interference prevents the actuator 206 from moving in one or two or more directions, which locks the wellhead valve in either an open position or a closed position. As will be appreciated by those skilled in the art, when the wellhead valve is locked in an open position that includes both a partially open position or a completely open position. In the non-limiting example depicted in FIG. 2B, the valve-position regulator 210 comprises a frame 212 that supports a moveable body 218 that is configured to be moveable between a first position and a second position. The frame 212 is connectible to the lever valve 204 so as to position the moveable body 218 adjacent the actuator 206 when the moveable body 218 is in the first position. One or more sizing plates 217 may be used to ensure a suitable distance between the actuator 206 and the moveable body 218. When the moveable body 218 is in the first position, the actuator 206 is in an unlocked position and it is possible to actuate the wellhead valve. When the moveable body 218 is in the second position the moveable body 218 physically interferes with and prevents the actuator 206 from moving in one, two or more directions. When the moveable body 218 is in the second position, the actuator 206 is in a locked position.

In the non-limiting example shown in FIGS. 2A and 2B, the moveable body 218 is an elongate member that can be moved into the first position that does not physically interfere with movement of the actuator 206. The moveable body 218 can extend into the second position and physically interfere with movement of the actuator 206 by blocking movement of the actuator 206 in at least one direction. In this embodiment, the moveable body 218 can be considered to act like a deadbolt.

The frame 212 can further include a connection plate 221 that may define one or more apertures, each for receiving a connector therethrough for connecting the valve-position regulator 210 to the lever valve 204. As will be appreciated by one skilled in the art, various other methods can be used to connect, releasably or otherwise, the valve-position regulator 210 to the lever valve 204.

The frame 212 can further comprise an adjustable assembly 220 that supports the moveable body 208. The adjustable assembly 220 is configured to adjust the position of the moveable body 218 relative to the actuator 206. For example, when the frame 212 is connected to the lever valve 204 the position of the frame 212 may be releasably fixed relative to the valve body 208 but the position of the adjustable assembly 220 can be changed by releasing one or more connectors that connect the adjustable assembly 220 to the frame 212.

The valve-position regulator 210 may further include a housing 214 that houses a body actuator 216 and the moveable body 218. The housing 214 is supported by the adjustable assembly 220. The housing 214 may also include a visual indicator 219 that allows a user to know whether the moveable body 218 is in the first position, the second position or therebetween.

The body actuator 216 can be any type of actuator that can move the moveable body 218 between the first position and the second position. In some embodiments of the present disclosure, the body actuator 216 is a manually-operated mechanism, such as a slide, or the body actuator 216 can be pneumatically powered, hydraulically powered or electrically powered. The housing 214 can further define one or more apertures (not shown) that will provide an actuator power line (i.e. a pneumatic line, a hydraulic line and/or an electrical line) access to the body actuator 216 therein.

In some embodiments of the present disclosure, the valve-position regulator 210 is spring loaded to move the moveable body 218 into the second position as a default. When the user want to move the moveable body 218 into the open position, for example when it is determined that it is safe to move the actuator 206, then the body actuator 216 is engaged to move the moveable body 218 into the first position.

As shown in FIG. 2B, the valve-position regulator 210 may optionally include an emergency bypass system 211 that comprises a removable locking pin 213 and a pivot pin 215. In the event that an emergency situation arises, and the moveable body is locked in an undesirable position, either the first position or the second position as the case may be, then the operator can remove the locking pin 213. This allows the housing 214 to pivot upon the pivot pin 215 and pivot away from the actuator 206 so that regardless of the position of the moveable body 210, the actuator can be actuated in response to the emergency situation.

Figure 3A:
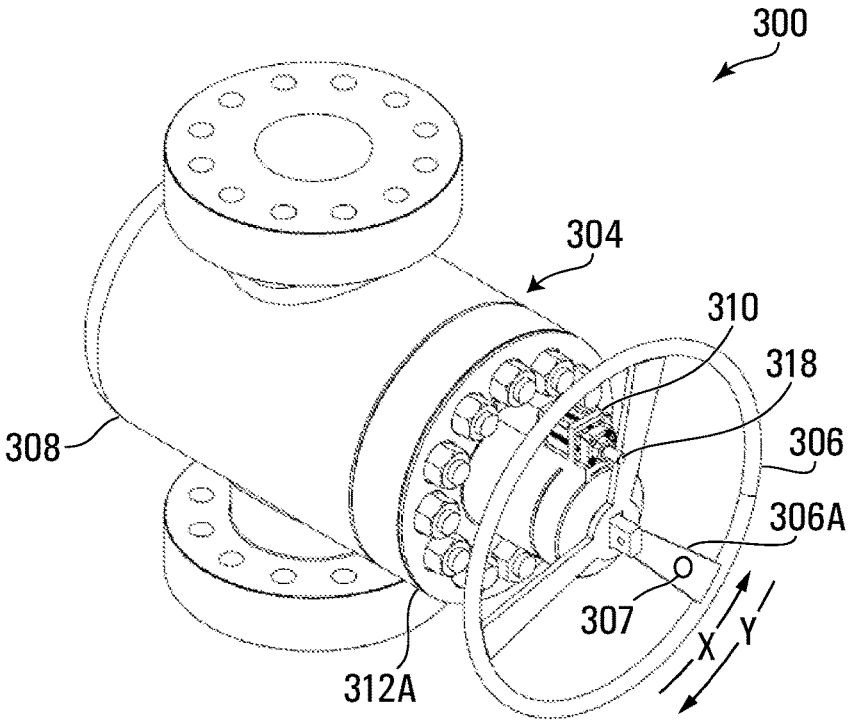
Figure 3B:
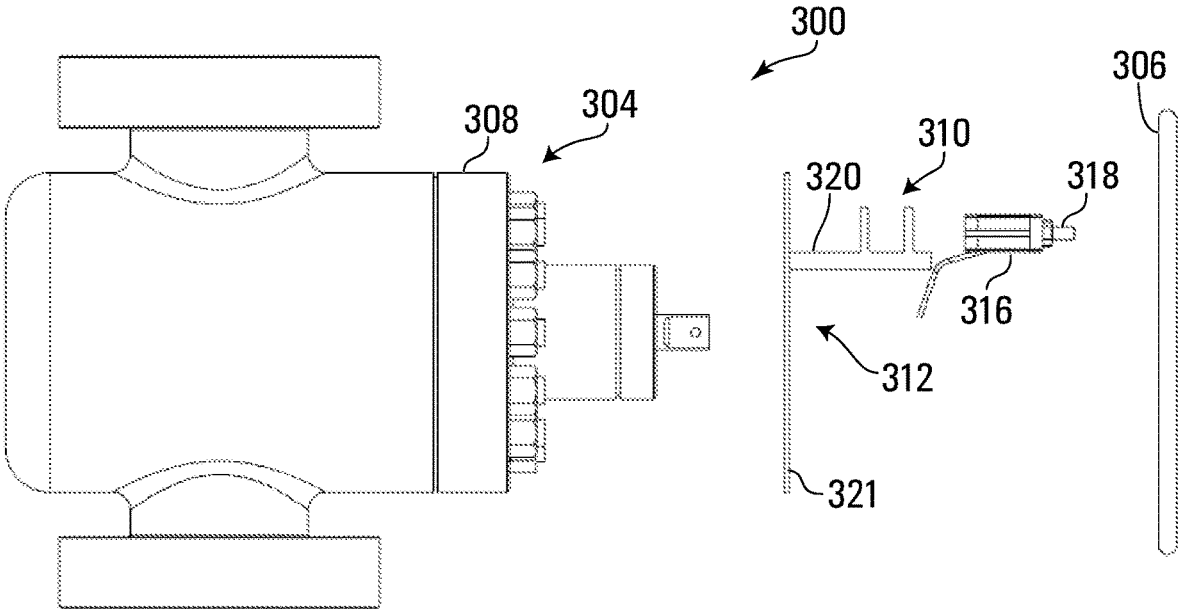

FIGS. 3A and 3B shows another example of a valve assembly 300 that comprises a wheel valve 304 and a valve-position regulator 310. In the non-limiting example of FIGS. 3A and 3B, the wheel valve 304 includes a rotatable actuator 306 and a valve body 308. The rotatable actuator 306 shown in FIGS. 2A and 2B is a rotatable wheel that can be rotatably actuated between a first position and a second position in order to open or close a wellhead valve (not shown) that is positioned within the valve body 308 or remote to the valve body 308. For example, the wellhead valve may be a butterfly valve, a gate valve, a disc and stem valve or any other type of valve that can be actuated by the rotatable actuator 306.

In some embodiments of the present disclosure, the valve body 308 can be connected with a wellhead or any fluid conduit that communicates fluids through, to or from the wellhead. Actuation of the rotatable actuator 306 will permit, restrict or stop at least a portion of the fluids from flowing through, to or from the wellhead. The skilled person will appreciate that in some embodiments of the present disclosure, the rotatable actuator 306 may also control a control system, such as a hydraulic controls system, a pneumatic control system, an electronic control system or combinations thereof that controls the actuation of a wellhead valve.

As shown in FIGS. 3A and 3B, the valve-position regulator 310 is configured to physically interfere with movement of the rotatable actuator 306. This physical interference prevents the rotatable actuator 306 from moving in one direction or two directions, which locks the valve in an open position, closed position or therebetween. In the non-limiting example depicted in FIG. 3B, the valve-position regulator 310 comprises a frame 312 that supports a moveable body 318 that is configured to be moveable between a first position and a second position. The frame 312 is connectible to the wheel valve 304 so as to position the moveable body 318 adjacent the rotatable actuator 306 when the moveable body 318 is in the first position. When the moveable body 318 is in the second position (as shown in FIG. 3A) the moveable body 318 physically interferes with and prevents the rotatable actuator 306 from moving in one, two or more directions. For example, when in the second position the moveable body 318 physically interferes with any further rotation of the rotatable actuator 306 from moving in direction X.

In some embodiments of the present disclosure, the moveable body 318 can be moved into the second position and physically interfere with any further rotation of the rotatable actuator 306 in direction Y. In some embodiments of the present disclosure, the moveable body 318 can physically interfere with rotation of the rotatable actuator 306 in any direction. For example, when the moveable body 306 is moved to the second position it can be received by an aperture 307 that is defined by a portion 306A of the rotatable actuator 306. In other examples, the moveable body 306 can be shaped (e.g., with a forked end) to receive at least part of the portion 306A of the rotatable actuator 306 when the moveable body 306 is in the second position so that the moveable body 306 physically interferes with movement of the rotatable actuator 306 in two directions.

In the non-limiting example shown in FIGS. 3A and 3B, the moveable body 318 is an elongate member that can be retracted into the first position where the moveable body 318 does not physically interfere with movement of the rotatable actuator 306. The moveable body 318 can extend into the second position and physically interfere with movement of the rotatable actuator 306.

The frame 312 can further include a connection plate 321 that may define one or more apertures, each for receiving a connector therethrough for connecting the valve-position regulator 310 to the wheel valve 304. As will be appreciated by one skilled in the art, various other methods can be used to connect, releasably or otherwise, the valve-position regulator 310 to the wheel valve 304.

The frame 312 can also include an adjustable assembly 320 that is connected to the connection plate 321. The adjustable assembly 320 is configured to receive and retain the moveable body 318 in the desired position so that when the moveable body 318 is in the first position the rotatable actuator 306 can rotate and when the moveable body 318 is in the second position movement of the rotatable actuator 306 is physically interfered with by the moveable body 318.

In some embodiments of the present disclosure the valve-position regulator 310 may further include a body actuator 316 that can be any type of actuator that can move the moveable body 318 between the first position and the second position. In some embodiments of the present disclosure, the body actuator 316 is a manually-operated mechanism, such as a slide, or the body actuator 316 can be pneumatically powered, hydraulically powered or electrically powered.

Figure 4A:
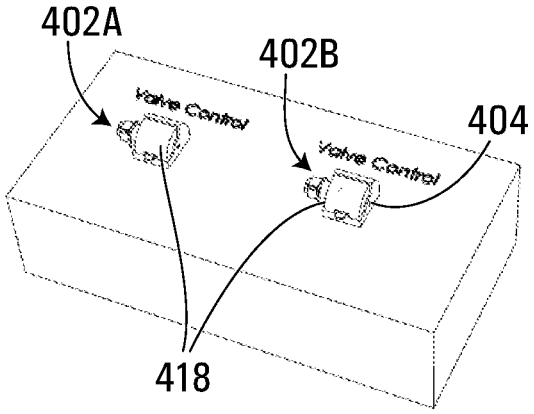
Figure 4B:
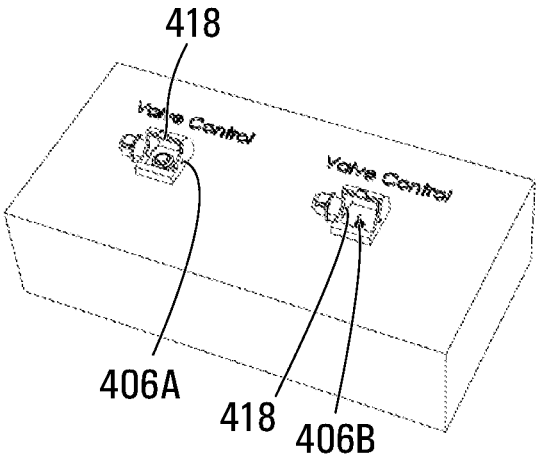
FIG. 4B shows an isometric view of the third valve-position regulator mechanism in a unlocked position; and, FIG. 4C shows an exploded, isometric view of the valve-position regulator mechanism.
Figure 4C:
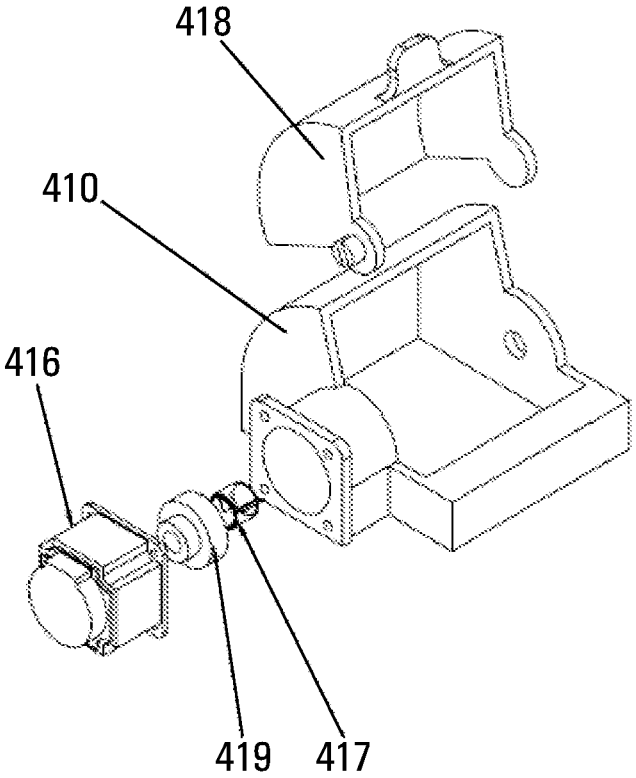

FIGS. 4A-C shows an example of a button-controlled valve control 402A and a switch-controlled valve control 402B that both include a valve-position regulator 410. The button-controlled valve control 402A includes a button actuator 406A—which is understood to include a touch-sensitive button or a touch screen—that is operatively connected to a wellhead valve (not shown) that can move and thereby permit, restrict or stop at least a portion of the fluids from flowing through, to or from the wellhead (not shown) when the button actuator 406A is actuated (i.e., touched, pushed inwardly and/or pulled outwardly). The switch-controlled valve control 402B includes a switch actuator 406B that is operatively connected to a wellhead valve that can move and thereby permit, restrict or stop at least a portion of the fluids from flowing through, to or from the wellhead (not shown) when the button actuator 406A is moved (i.e. pushed upwardly and downwardly). For example, the wellhead valves that are controlled by the button actuator 406A and the switch actuator 406B may be a butterfly valve, a gate valve, a disc and stem valve or any other type of valve.

The skilled person will appreciate that in some embodiments of the present disclosure, the button-controlled valve control 402A and the switch-controlled valve control 402B may also control a control system, such as a hydraulic control-system, a pneumatic control-system, an electronic control-system or combinations thereof that controls the actuation of a wellhead valve.

The valve-position regulator 410 comprises a moveable body 418 that is moveable between a first position (FIG. 4B) and a second position (FIG. 4A). In the first position a user can access and actuate either of the button actuator 406 A and/or the switch actuator 406B. In the second position a user is physically interfered from accessing and actuating either of the button actuator 406A and/or the switch actuator 406B. The moveable body 418 can be rotatable, pivotable, slidable or move in any other suitable fashion between the first and second positions.

In the non-limiting example of FIGS. 4A-C, the valve-position regulator 410 is shown as comprising a body actuator 416 that is configured to move the moveable body 418 between the first and second positions. In some embodiments of the present disclosure, the body actuator 416 is a manually-operated mechanism, or the body actuator 416 can be pneumatically powered, hydraulically powered or electrically powered.

In some embodiments of the present disclosure, the valve-position regulator 410 can include a safety feature that decreases or avoids incidence of crushing a part of a user's body when the moveable body 418 moves into the first position. For example, a spring 417 can be pre-loaded with a pre-determined force that reduces the amplitude of a force that can be applied to move the moveable body 418 into the first position. The spring 417 can be a torsion spring, a leaf spring or any other type of spring can provide this safety feature.

In the embodiments of the present disclosure that relate to the valve-position regulator 410 including a body actuator 416, a coupler 419 can be configured to operatively connect the body actuator 416 to the moveable body 418, either through the spring 417, or not.

Some embodiments of the present disclosure relate to a wellhead identifier 500 that is configured to allow an operator to identify a specific wellhead upon a well pad so that information can be cross-referenced with any particular well operation that may be performed on the wellhead and/or the well therebeneath.

Figure 5A:
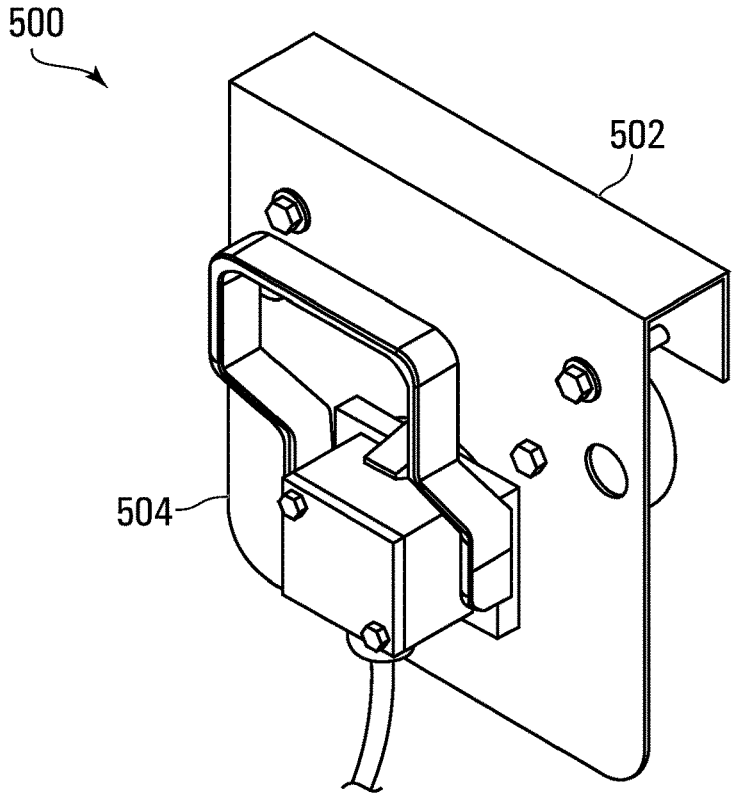
Figure 5B:
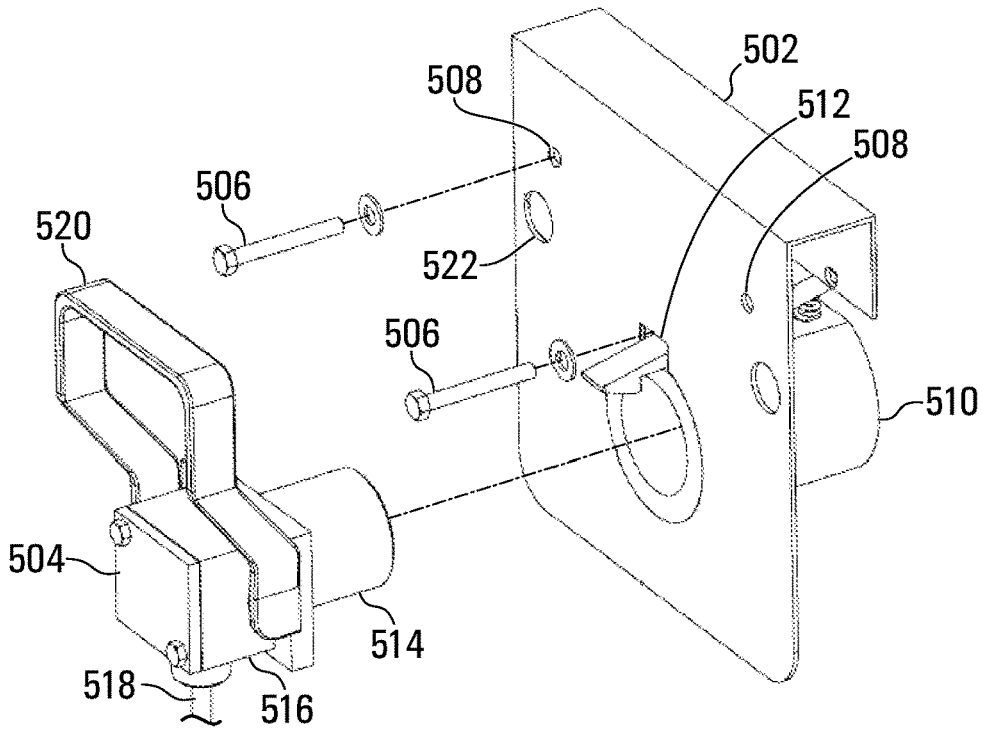

In the non-limiting example of FIGS. 5A and 5B, the wellhead identifier 500 comprises a mountable frame 502 and a location sensor 504. The mountable frame 502 can be releasably mounted to a portion of a wellhead, for example a handrail, by one or more fasteners 506 that are received within associated fastener apertures 508 that are defined by the mountable frame 502. The mountable frame 502 also defines a location sensor holster 510 that is configured to releasably receive a sensor portion 514 of the location sensor 504. The mountable fastener 502 may also include a releasable retaining-mechanism 512 for releasably holding the portion of the location sensor 504 within the location-sensor holster 510.

One or more mountable frames 502 can be releasably mounted upon the wellhead (optionally at different positions). Each mountable frame 502 is configured to generate a unique signal, such as magnetic signature, an electronic signature or other type of signature. In some embodiments of the present disclosure, the holster 510 is configured to generate the unique signal. When the wellhead is receiving a specific operation, for example a fracturing operation, a wireline operation, a coiled tubing operation or other applicable operations, the location sensor 504 can be inserted into the holder 510 and the unique signal of that wellhead will be received by the location sensor 504.

The location sensor 504 can comprise the sensor portion 514 that is configured to detect the unique signal that is generated by mountable frame 502. In order to maintain fidelity and reduce false identifier-signal generation, the sensor portion 514 may require to be in close physical proximity to the holster 510. In some embodiments of the present disclosure, the sensor portion 514 must be received at least partially within the holster 510 in order to detect the unique signal generated by the mountable frame 502. Upon detecting the unique signal, a transmitter portion 516 can generate and transmit an identifier signal that is communicated to a user, for example to a controller circuit that a user has access to, so that the user knows what wellhead of a well pad is receiving a specific operation. The transmitter portion 516 can transmit the identifier signal by a wire 518 or it may be transmitted wirelessly. Optionally, the location sensor 504 can include a handle 520 for ease of handling.

In some embodiments of the present disclosure, the mountable frame 502 may also define one or more tether apertures 522 for receiving a portion of a tether therethrough for providing a back-up for securing the mountable frame 502 to the wellhead.

In some embodiments of the present disclosure, the wellhead identifier 500 may comprise a different type of location sensor 504 that can also be configured to operate to detect which wellhead is receiving an operation based upon different types of information that may be available from the wellhead. Examples of such information include, but are not limited to: pressure information, optical information, radio-frequency identification, ultrasonic, global positioning information, a digital compass or combinations thereof.

Some embodiments of the present disclosure relate to one or more sensors that can detect a condition within a wellhead, the conduits associated with the wellhead, the well below the wellhead or combinations thereof for generating a condition-based information signal. In some embodiments of the present disclosure, the condition-based information signal is an object-based sensory information that relates to the position of an object within the wellhead or the well therebelow. The object-based information may be based upon the position of objects that are detected within the wellhead, the position of objects within the well, the position of a wellhead control mechanism or combinations thereof. In some embodiments of the present disclosure, the condition-based information signal is a fluid-based sensory information that relates to the condition of fluid within the wellhead, the conduits associated with the wellhead, the well below the wellhead or combinations thereof. The fluid-based sensory information may be based upon fluid pressure, flow rates or combinations thereof.

Figure 6:
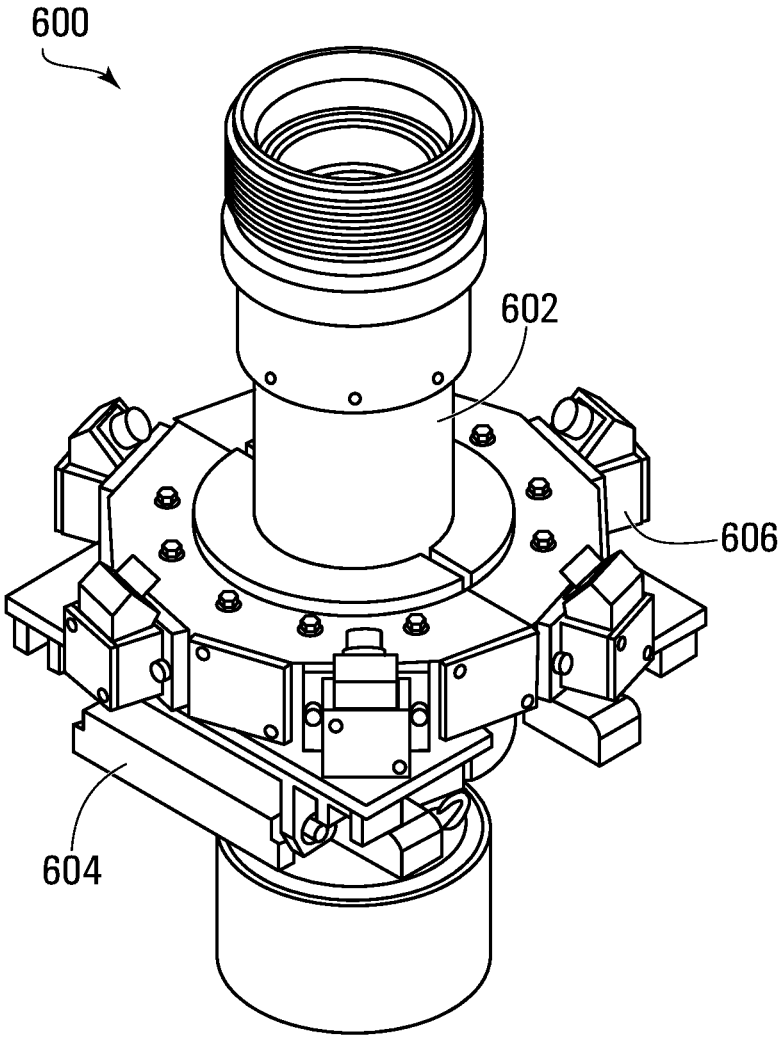
FIG. 6 is an isometric view of an example of a sensor assembly according to embodiments of the present disclosure.

FIG. 6 shows one embodiment of a sensor assembly 600 that is configured to be connected with a wellhead to detect when an object is passing through a given section of the wellhead that includes the sensor assembly 600 for generating object-based sensory information. The sensor assembly 600 comprises a connector 602, a mounting frame 604 and a sensor array 606.

Figure 7A:
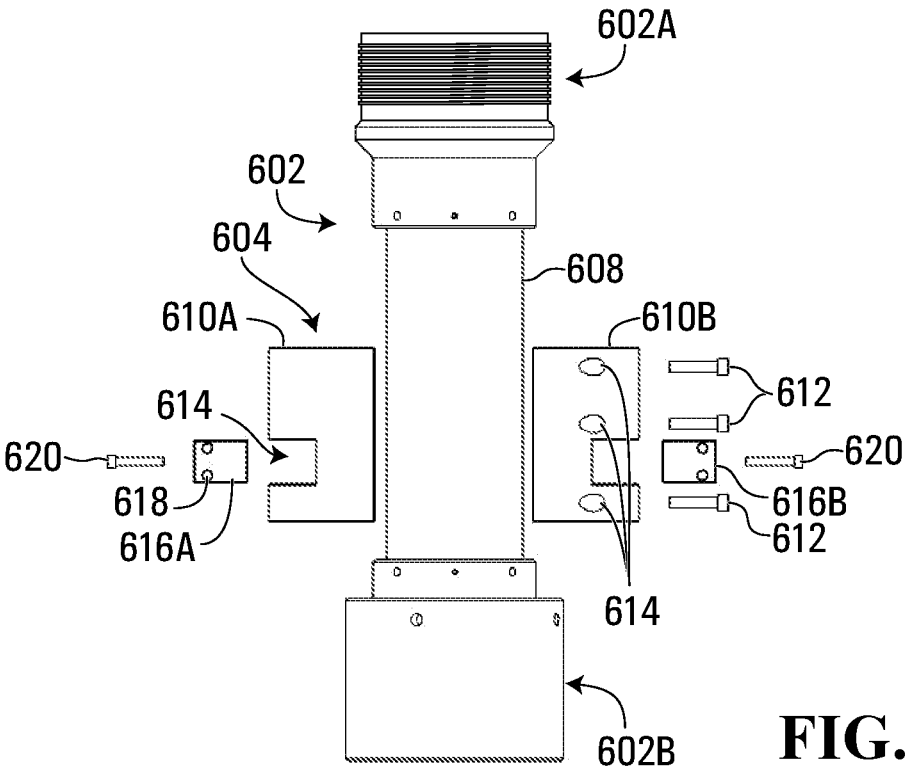
Figure 7B:
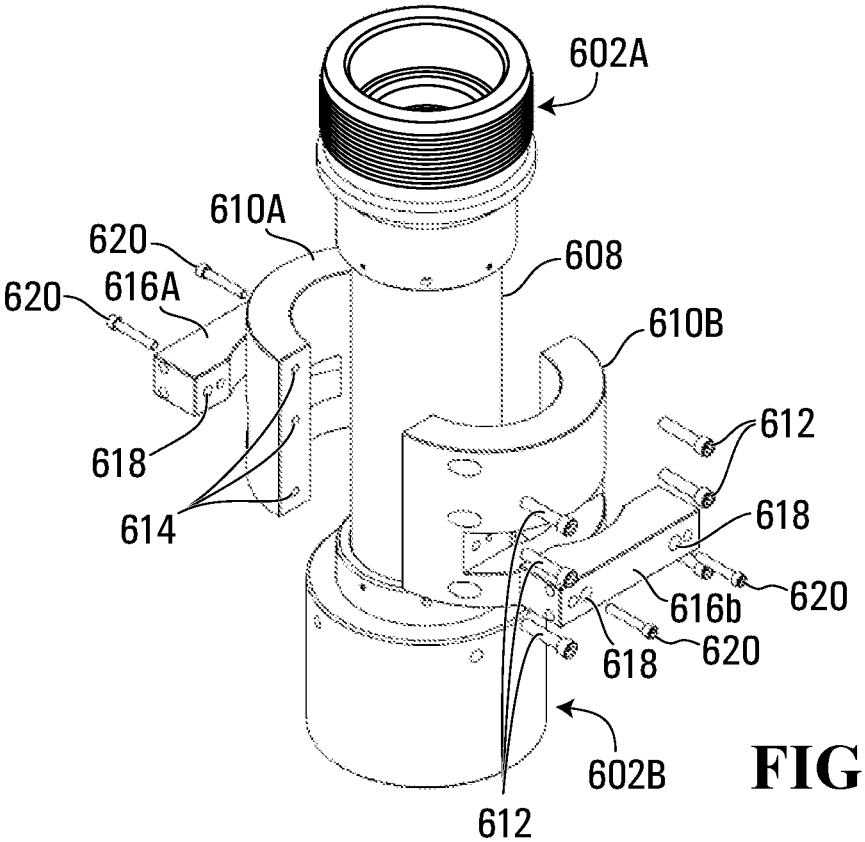

FIG. 7A and FIG. 7B each show a non-limiting example of the connector 602 that is a tubular member with an internal bore (shown in FIG. 6). The connector 602 is configured to be connectible in-line with the wellhead so that the internal bore of the connector 602 is in fluid communication with a central bore of the wellhead. When the connector 602 is connected in-line with the wellbore, any fluids or objects that are introduced into the wellhead above the connector 602 will pass through the central bore of the wellhead and through the internal bore of the connector 602. The connector 602 has a first end 602A, a second end 602B and a central portion 608 defined therebetween. The internal bore of the connector 602 can extend between each end 602A, 602B is configured to be connected to a portion of the wellhead. For example, the first end 602 A may comprise a first threaded connector (e.g., such as a pin threaded connection) and the second end 602B may comprise a second threaded connector (e.g., such as a box threaded connection) or vice versa. As will be appreciated by one skilled in the art, the ends 602A, 602B may comprise different types of connectors that allow the connector 602 to be connected to a portion of the wellhead to provide fluid communication therethrough, such connectors can include but are not limited to: flanged connections, clamped connections, threaded connections and combinations thereof.

In some embodiments of the present disclosure, the ends 602A, 602B and the connector 608 are made out of different materials. For example, the ends 602A. 602B may be made from one or more ferromagnetic materials and the connector 608 may be made from one or more non-ferromagnetic materials, or vice versa.

The mounting frame 604 comprises a brace that is made up of at least two brace components 610A, 610B that are configured to mate with each other about the connector 608. For example, the two brace components 610A, 601B can be C-shaped with an internal surface that is configured to substantially abut the outer surface of the connector 608. The two brace components 610A, 610B are also configured to mate by one or more brace connectors 612 that can be received through one or more brace connector apertures 614 that are defined by one or both of the brace components 610A. 610B. Each brace connector 612 can be received within a brace connector aperture 614 in one brace component 610A and within a brace connector aperture 614 in the other brace component 610B for releasably mating the two brace components 610A, 610B to each other and about the connector 608.

Each brace component 610A. 610B may define a mount-receiving slot 614 that are each configured to releasably receive therein a mount 616. For example, a first mount 616A may be releasably received in the brace component 610A and a second mount 616B may be releasably received within the brace component 610B. In some embodiments of the present disclosure, the mount-receiving slots 614 are diametrically opposed to each other so that each mount 616A, 616B that are received therein are also diametrically opposed to each other. The mounts 616A, 616B may each define at least one mount-connector aperture 618 that are each configured to receive a mount connector 620 therein. The mount connector 620 may be inserted into and extend through an associated mount-connector aperture 618 and into a portion of a brace component 610A, 610B so that each mount 616A, 616B is releasably received within one of the mount-receiving slots 614.

Figure 8A:
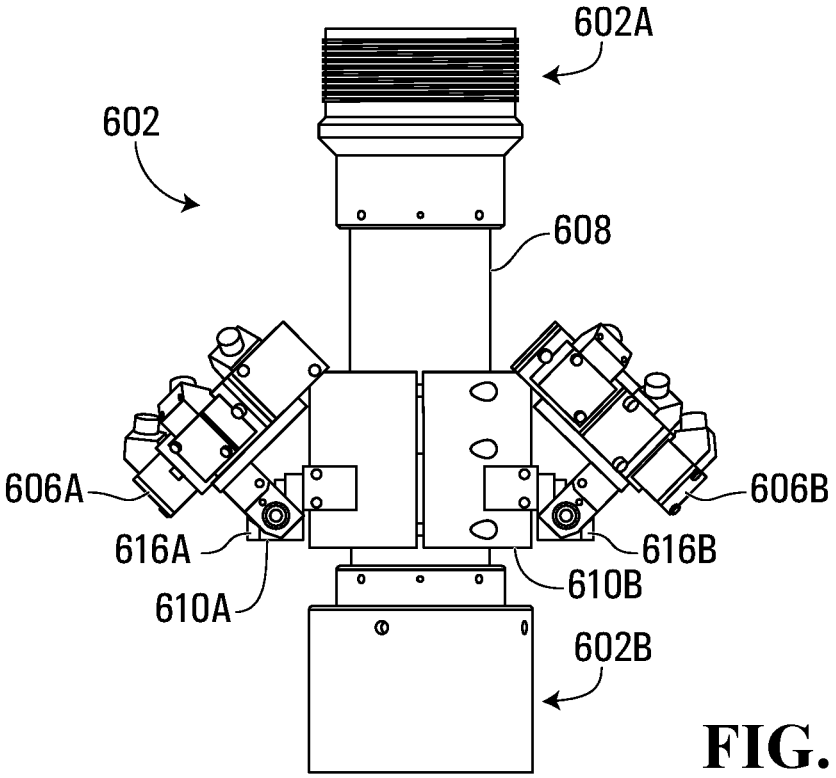
Figure 8B:
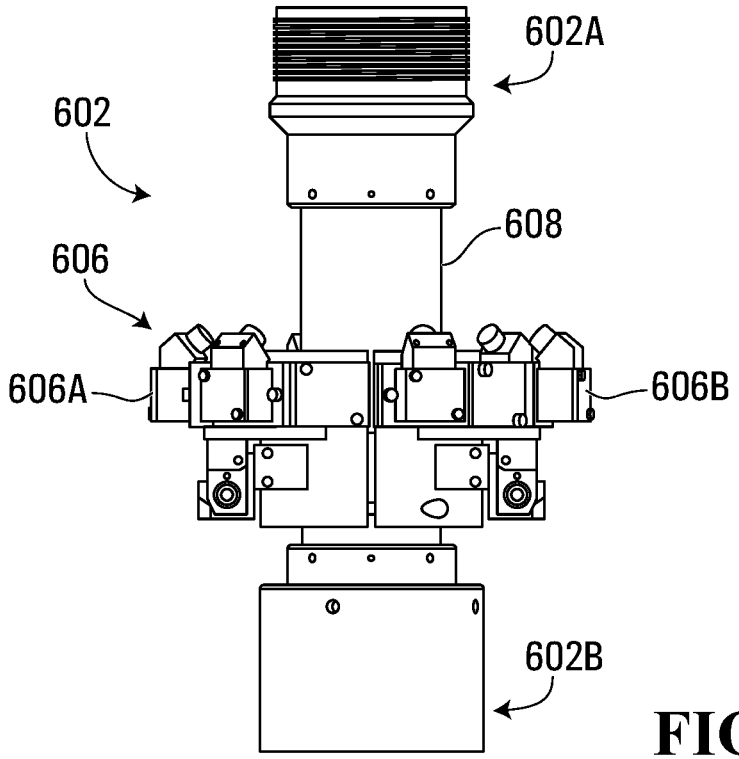

FIG. 8A and FIG. 8B each show a sensor array 606 that comprises a first part 606A and a second part 606B. The first part 606A may be pivotally supported by the first mount 616A and the second part 606B may be pivotally supported by the second part 616B. The first part 606A and the second part 606B can pivot between a first position (see FIG. 8A) and a second position (FIG. 8B). In the first position the two parts 606A, 606B are disconnected from each other and the sensor array 606 is still mounted about the connector 608 but it is inoperable. In the second position two parts 606A, 606B are connected to each other about the connector 608 and the sensor array 606 can operate.

When in the second position, the sensor array 606 can operate by generating a magnetic field and detecting when a ferromagnetic object within the internal bore of the connector 608 approaches, passes through or is moving away from the magnetic field within the internal bore of the connector 608. In some embodiments of the present disclosure the sensor array 606 can also detect and/or measure dimensions of the object including at least the diameter and length of the object within the internal bore of the connector 608.

In some embodiments of the present disclosure the sensor array 606 can be the sensors as described in any one of: U.S. Pat. Nos. 9,097,813; 10,221,678; and, 9,909,411, the entire disclosures of which are incorporated herein by reference.

In some embodiments of the present disclosure, the sensor array 606 comprises one or more magnetic-field generators, in the form of one or more magnets, and one or more magnetic-field sensors. The one or more magnetic-field generators are configured to generate the magnetic field that at least partially extends into the internal bore of the connector 602. In some embodiments of the present disclosure, the one or more magnetic-field generators are configured to generate the magnetic field when the sensor array 606 is in the second position.

The one or more magnetic-field generators generate a magnetic field that penetrates at least partially across but preferably substantially across the entire internal bore of the sensor array 606. The magnetic field may be represented by magnetic-field lines that leave the north pole of each magnetic-field generator and return to the south pole of each respective magnetic-field generator. Either one of the poles may face the internal bore of the sensor array 606. When magnetic-field lines return from the north pole to the south pole they penetrate through the internal bore. There are infinite possible return paths that the magnetic-field lines may utilize to return from north to south pole, and some of those paths pass through one or more of the magnetic-field sensors. The magnetic-field sensors produce an electrical signal that relates to the strength of the magnetic field passing through it. In other words, the electrical output signal from each magnetic-field sensor relates to the number of the magnetic-field lines passing through each magnetic-field sensor. Some of the return paths have lower magnetic resistivity that other paths, which causes more magnetic-field lines returning through those paths.

When an object that can perturb or change one or more properties of the magnetic field moves towards, through or away from the sensor array 606 and the magnetic field, the object perturbs or alters the magnetic circuit by changing the magnetic resistivity of some of the paths that the field lines travel. This perturbation may change the number of the magnetic-field lines returning through some paths. Some of the altered paths are the paths that pass through one or more of the magnetic-field sensors, which changes the number of the returning magnetic-field lines that pass through the one or more magnetic-field sensors, which in turn causes changes in the output from these one or more magnetic-field sensors.

If multiple magnetic-field generators are used in the sensor array 606, the magnetic-field generators may be configured such that the same magnetic pole of each magnet faces the internal bore of the sensor array 606. The magnetic-field generators create a magnetic field that corresponds to the magnetic poles facing the center of the sensor array 606. This magnetic field will be strongest on or near an internal wall of the sensor array 606 that defines the internal bore, in front of the magnetic-field generators, and the strength of the magnetic field may decrease distally from each magnet-field generator. Using multiple magnetic-field generators may create a substantially homogeneous and evenly distributed magnetic field that extends at least partially and, in some embodiments, substantially across the internal bore of the sensor array 606.

The magnetic-field sensors are used to detect one or more properties of the magnetic field such as the field strength, magnetic flux, polarity and the like. The magnetic-field sensors may be configured to detect changes in the magnetic field or at the center of the sensor array 606. In some embodiments of the present disclosure, the magnetic-field sensor may be positioned upon a ferromagnetic rod, which can attract the magnetic field toward the magnetic-field sensors.

This change in one or more properties of the magnetic-field, such as the magnetic-flux density, is detected by the magnetic-field sensors. When the object is closest to a particular magnetic-field sensor near the internal wall of the sensor array 606, most of the magnetic field directed towards that particular magnetic-field sensor is drawn toward the object, which causes that particular magnetic-field sensor to detect less of the magnetic-field strength. As the object moves away from the particular magnetic-field sensor, the magnetic field strength detected by the magnetic-field sensor increases drastically depending on how far the surface of the ferromagnetic object is. By observing the magnetic field strength detected by a particular magnetic-field sensor, the distance between the surface of the ferromagnetic object and the magnetic-field sensor can be determined.

The absolute magnetic-field strength read by the magnetic-field sensors depends on the strength of the magnetic-field generators within the sensor array 606. However, changes in the magnetic-field strength within the sensor array 606 can be due to the presence of a ferromagnetic object and the magnitude of those changes can depend on the dimensions and/or material properties of the ferromagnetic object and its location within the sensor array 606.

As will be appreciated by those skilled in the art, the types of objects that the sensor array 606 can detect include ferromagnetic objects that can be introduced into the wellhead during one or more different well operations.

As will also be appreciated by those skilled in the art, the sensor assembly 600 that is configured to be connected with a wellhead to detect when an object is passing through a given section of the wellhead that includes the sensor assembly 600 is not limited to only magnetic sensors, as described herein above. For example, the sensor assembly 600 may comprise other types of sensors may be configured to detect when an object is passing through a given section of a wellhead, including but not limited to: acoustic sensors, ultrasonic sensors, vibration-detecting sensors and x-ray based sensors.

Figure 9:
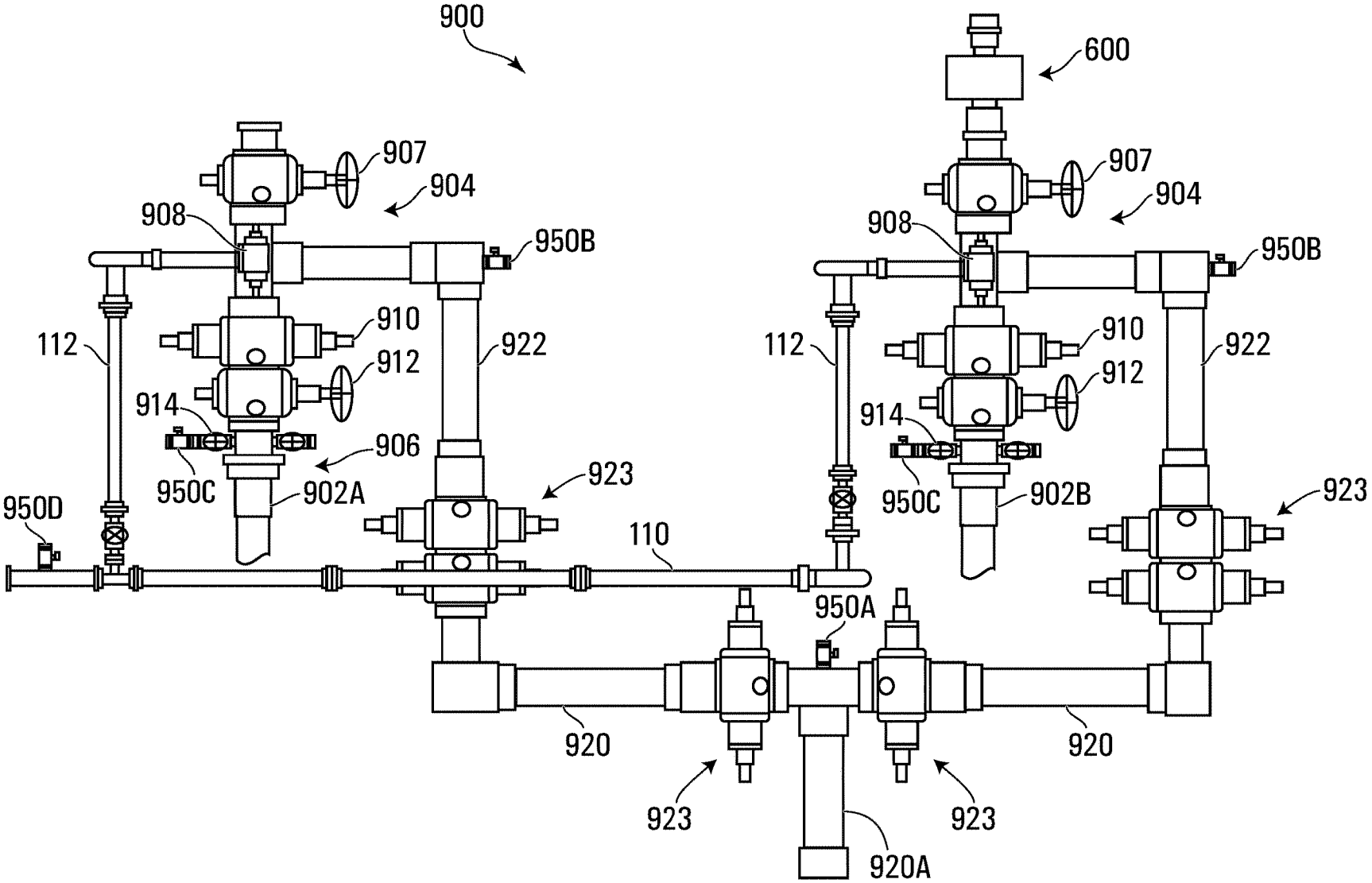
FIG. 9 shows an example of two wellheads that are fluidly connected to a hydraulic fracturing zipper manifold, with the sensor assembly of FIG. 6 coupled to one of the wellheads.

FIG. 9 shows a portion of a well pad 900 that includes a first wellhead 902A and a second wellhead 902B. The wellheads 902A, 902B each further comprise many of the same components arranged above the surface of the portion of the well pad 900 in a Christmas tree. The components of the Christmas tree will be described herein with reference to the first wellhead 902A but it is understood that unless otherwise indicated that the Christmas tree of the second wellhead 902B comprises the same components.

The Christmas tree of the first wellhead 902 A comprises an upper portion 904 and a lower portion 906. The upper portion 904 is distal from the surface of the portion of the well pad 900 and the lower portion 906 is proximal to the surface. The upper portion 904 is configured to receive one or more components of well-operation equipment therethrough. For example, coiled tubing, wireline, slickline, braided line, jointed tubing, tubing and other components can be inserted into the upper portion 904 and introduced into lower portions of the wellhead 902A and the well below the surface. Vice versa, components can be retrieved from the well below the surface and pass through the lower portion and upper portion of the wellhead 902A, 902B. In wellheads that comprise the sensor assembly 600, the components that pass through the upper portion 904 may also pass through the internal bore of the connector 608.

The Christmas tree can further comprise one or more wellhead valves such as, but not limited to: a swab valve 907 (which are also referred to as a crown valve), a pump-down valve 908, a hydraulic master-valve 910, a manual master-valve 912 and one or more side port valves 914. The Christmas tree components can be manually operated, remotely operated and/or automated to actuate based upon one or more of a control system that uses hydraulic power, pneumatic power, electronic power or combinations thereof.

FIG. 9 shows the two wellheads 902A. 902B as being in fluid communication with a hydraulic fracturing zipper manifold 920 by being in fluid communication with an input conduit 922 that connects with the wellhead 902A, 902B at or about the position of the wing valves 908. A secondary input conduit 112 and a fracturing output conduit 122 (shown in FIG. 1) may also be in fluid communication with each wellhead 902A, 902B at or about the position of the wing valves 908. Actuation of the wing valves 908 can determine whether or not the wellhead 902A, 902B is in fluid communication with the fracturing output conduit 924 or the secondary input conduit 112. Actuation of the zipper manifold valves 923 can determine whether or not the wellhead 902A, 902B is in fluid communication with the fracturing input conduit 922.

During fracturing operations, a high pressure pump (not shown) can be in fluid communication with the zipper manifold 920 to deliver high pressure fluids into the wellhead 902A, 902B via the input conduit 922.

As shown in FIG. 9, the actuation of valves within fracking conduits on the portion of the well pad 900 may be regulated by a system that comprises one or more valve-position regulators, one or more pressure sensors 950 and/or one or more sensor assemblies 600.

The one or more pressure sensors 950 are configured to detect the state of any fluids (or lack thereof) within the conduit to which they are operatively coupled for generating fluid-based sensory information. For example, a pressure sensor 950A can be positioned to detect the fluid pressure within the zipper manifold 920, a pressure sensor 950B can be positioned to detect the fluid pressure within each of the input conduits 922, a pressure sensor 950C can be positioned to detect the fluid pressure within the side port 914 (which may be in fluid communication with an annular space between the well casing and the well bore tubing), a pressure sensor 950D can be positioned to detect the fluid pressure within the pump-down conduit 110 and/or the secondary input conduit 112. As will be appreciated by those skilled in the art, one or more pressure sensors 950 may also be placed within the lubricator of the wellhead, within the sensor array 600, between two valves that are within or downstream of the zipper manifold 920 (for example between valve 910 and valve 912).

The one or more pressure sensors 950 are configured to each generate a pressure signal that is communicated to a computing device and/or a controller circuit (not shown) so that a user will receive fluid-based information about which wellhead 902A, 902B may be receiving a hydraulic fracturing well stimulation treatment. The fluid signal may be communicated to the computing device and/or controller circuit either through a wired connection or a wireless connection. The fluid-based information may be based upon pressure-based information and/or flow-based information. With this fluid-based information, the user can avoid unsafely actuating any closed valve that has a large pressure differential across it and the user can avoid unsafely actuating any open valve that has a high-pressure fluid flowing through it. Furthermore, the fluid-based information from the one or more pressure sensors 950 may enable the user to: confirm pressure tests of the fracking conduits; monitor and record the pressures within the fracking conduits during a fracking operation; ensure that any closed valves within the fracking conduits are equalized and not experiencing a high pressure-differential thereacross before actuating such closed valves to open; confirm that the desired valves are operational and in the correct position within the fracking conduits; detect pressure leaks; receive an alert of a potential physical failure of a valve; or, combinations thereof. In some embodiments of the present disclosure, the sensor 950 can be one or more fluid-pressure sensors that are operatively coupled to a conduit to detect the pressure of a fluid therein. The one or more fluid-pressure sensors can be, but are not limited to: a single-point, absolute pressure sensor; a differential pressure sensor, a gauge pressure sensor; a piezoelectric pressure sensor; a strain gauge pressure sensor; a capacitive pressure sensor; an inductive pressure transducer, a resistive pressure transducer; a linear voltage differential transformer, an optical pressure sensor; a fiber optic pressure sensor; a surface acoustic wave sensor; a bridgeman pressure gauge; and, combinations thereof.

In some embodiments of the present disclosure, the sensor 950 can be one or more fluid-flow sensors that are that that are operatively coupled to a conduit to detect the flow rate of a fluid therein for generating fluid-based sensory information. For example, the sensor 950 could be one or more flowmeters positioned within in a conduit to detect fluid flow for assessing which wellhead 902 is receiving a fluid treatment. The one or more fluid-flow sensors can be, but are not limited to: a turbine flow sensor; an optical flow sensor, a fiber optic flow sensor; an electromagnetic flow sensor; a resistance temperature detector sensor; an oval gear flow sensor; an ultrasonic flow meter; a vortex flow sensor; a venture flow sensor, and, combinations thereof.

In some embodiments of the present disclosure, the sensor 950 can be one or more of a pressure sensor and one or more of a fluid-flow sensor.

In some embodiments of the present disclosure may include other sensors 951 that are used to provide object-based sensory information, for example by assessing the depth that a well-operation tool may be present within a well or its position within a wellhead. The other sensors 951 can generate well-operation tool derived sensory information, which is a sub-set of object-based sensory information. Some examples of such sensors 951 may include a counter sensor that counts the number of rotations that a spool or other of wireline, slick line, braided line or coiled tubing has undergone to estimate the depth within the well of the wireline, slick line, braided line or coiled tubing and the well-operation tool connected thereto. Further examples of such sensors 951 may include a counter sensor, which may also be referred to as a measuring head, that measures the tension in a wireline, a slickline or a braided line at a shiv, or other supporting rotatable member, that are positioned between the spool and the wellhead and/or the depth of a well-operation tool that is operatively connected to the wireline, a slickline or a braided line.

Some further examples of such sensors 951 include a sensor that can detect a detectable signal that is generated by a detectable signal generator for generating object-based sensory information. In some embodiments of the present disclosure the sensor 951 is operably coupled to a portion of the wellhead or proximal to the wellhead and the detectable signal generator can be affixed to an object that can pass through the wellhead. For example, the system may comprise a radio frequency identification (RFID) system, and the sensor 951 is an RFID sensor, such as an RFID receiver, and an RFID signal generator, such as an RFID transmitter, is affixable to the object. The object may be a portion of a wellbore tubular such as a casing collar locator, any other section of wellbore tubular, a portion of a wireline, a portion of a slickline, a portion of a braided line, a portion of coiled tubing or a well-operation tool. The sensor 951 can detect when the detectable signal generator approaches to determine the position within the well of the portion of the wireline, slick line coiled tubing or a tool deployed thereupon. As will be appreciated by those skilled in the art, the sensor 951 can be affixed to the object and the detectable signal generator may be operably coupled to the wellhead. The sensor 951 can be any type of sensor other than RFID that is configured to detect a signal that is transmitted by the object, for example, the sensor 951 may be a magnetic sensor, an ultrasonic sensor, an optical sensor, an acoustic sensor, or combinations thereof.

In some embodiments of the present disclosure, the object-based sensory information obtained by the sensor 951 may be part of the data captured that is otherwise captured by other systems of a wire-line truck or coiled-tubing truck.

The sensor 951 may also be associated with, for example by being affixed to, a tool trap of the wire line lubricator for detecting when a well-operation tool is pulled out of the well and up past the tool trap. For example, the sensor 951 can detect when the tool trap is closed, then opens, then closes again, and this pattern indicates that the well-operation tool has passed out of the well and above the tool trap.

In some embodiments of the present disclosure, the sensor 951 may also be operatively coupled with one section of a wellhead, for example a lubricator on the wellhead, and the sensor 951 is configured to detect when an object, for example a portion of a tubular such as a casing collar locator a section of tubular, a portion of a wireline, slickline, braided line, a portion of coiled tubing, comprises a transmitter and has entered into or passed through the associated section of the wellhead. For example, the objection and transmitter can produce a detectable signal, for example an RFID signal, a magnetic signal, an ultrasonic signal, an optical signal, an acoustic signal, or combinations thereof that is detectable by the one or more sensors 951 to provide object-based information so that the user knows when the object is proximal to the one or more sensors 951. In some embodiments of the present disclosure, the sensor 951 could also be one or more optical sensors for detecting a position of an item on the wellsite, such as for detecting the position of a wellhead valve, or the operational position of a lubricator. As will be appreciated by those skilled in the art, the sensor 951 may comprise part of the object and the detectable signal may be generated by a section of the wellhead.

FIG. 9 also shows the upper portion 904 of wellhead 902B as comprising the sensor assembly 600 so that a user interface and/or controller circuit can receive object-based information about objects that may be moving through a section of the wellhead 902B. FIG. 9 also shows some examples of positions where the one or more sensors 950A. B, C and D may be located on the portion of the well pad 900.

Figure 10:
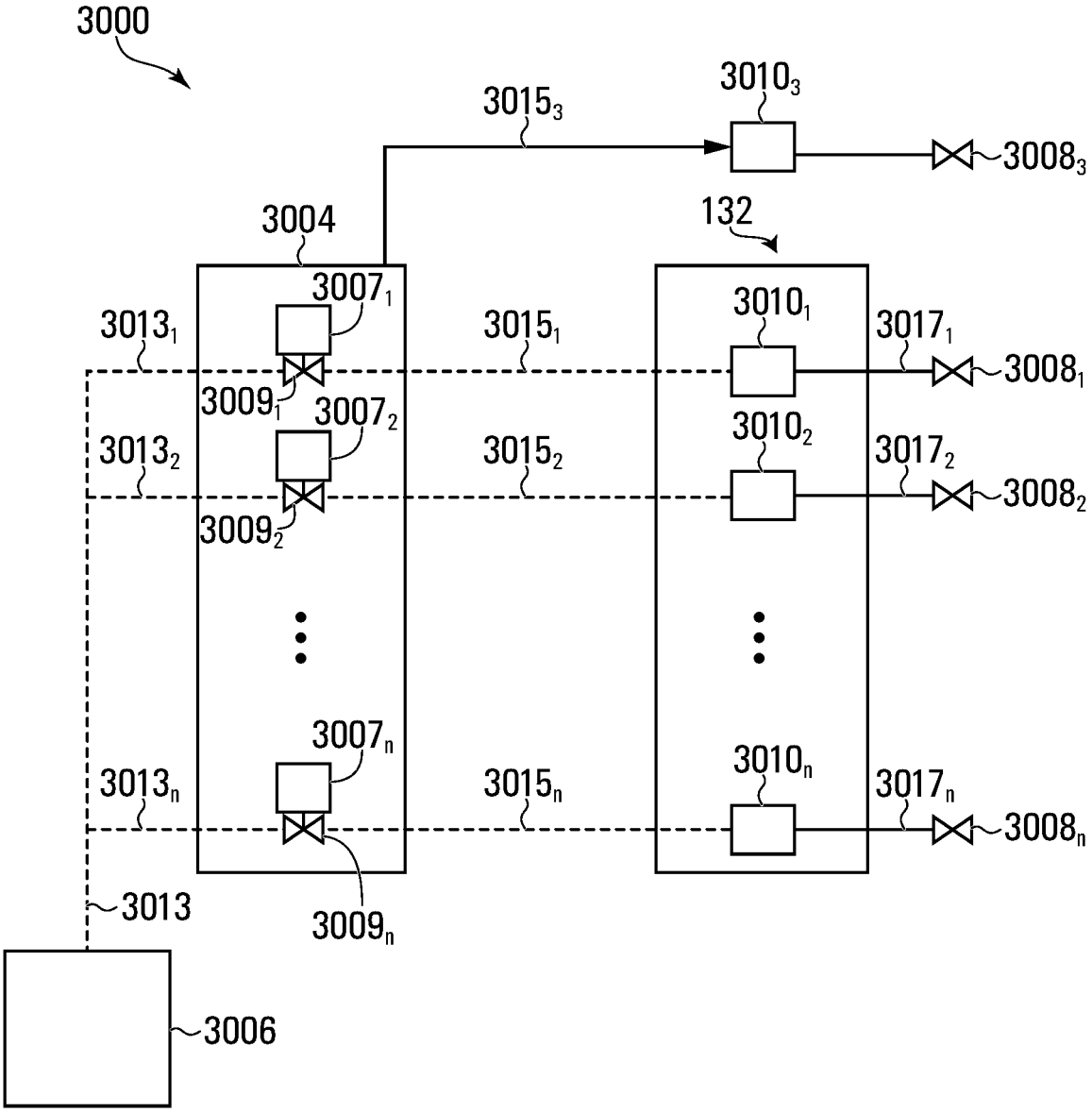
FIG. 10 is an example of a schematic that represents one embodiment of the present disclosure for regulating one or more wellhead control mechanisms of one or more wellheads.

FIG. 10 is a schematic that represents a system 3000 for regulating a wellhead control mechanism of one or more wellheads, the wellhead control mechanism is generally represented by the reference number 3008 in FIG. 10 through FIG. 13A/B. For example, the wellhead control mechanism can be, but is not limited to: the swab valve 907, the pump-down valve 908, the hydraulic master-valve 910, one or more side port valves 914, one or more zipper manifold valves 923, a flow-back valve, a pump-down valve and any other valve. In some embodiments of the present disclosure, the wellhead control mechanism may be a blow-out preventer or a choke.

The system 3000 comprises a valve actuation panel 3004 and one or more valve position regulators 3010. As will be appreciated by those skilled in the art, the valve position regulator 3010 can be any one of the valve position regulators 210, 310 and 410 described herein above. The valve actuation panel 3004 can be in operative communication with a power source 3006 via one or more conduits 3013. The power source 3006 can be a source of hydraulic power fluid or pneumatic power fluid. The one or more conduits 3013 can conduct the power fluids (hydraulic fluids or pneumatic fluids) to one or more valves 3009 of the valve actuation panel 3004. The valve actuation panel 3004 also comprises one or more actuators 3007 that are each associated with the one of one or more valves 3009. For example, the one or more conduits 3013 may split into a first conduit 3013*i*, a second conduit 30132 and any number of further conduits $\mathbf{3013}_n$. The first conduit 3013*i* conducts the power fluid from the power source 3006 to a first valve 3009*i* of the valve actuation panel 3004. For example, the one or more actuators 3007 may each be a switch so that when a switch 3007*i* is actuated, the first valve 3009*i* can move between an open position and closed position. As shown in FIG. 10, the valve position regulator 3010*i* can be operatively coupled to an accumulator 132 for regulating the actuation of an actuator of the accumulator 132. When the first valve 3009*i* is closed the power fluid does not move past the first valve 3009*i*. When the first valve 3009*i* is open the power fluid can be conducted along a conduit 3015*i* to a valve position regulator 3010*i* and the power can energize the valve position regulator 3010*i*. An energized position regulator 3010*i* can then move the moveable body of the valve position regulator 3010*i* between a first position and a second position, as described herein above regarding the valve position regulators 210, 310 and 410. In some embodiments of the present disclosure, the moveable body of the one or more valve position regulators 3010 are biased to be in the second position so that the position of the one or more valves 3008 are locked in position. When the moveable body of the valve position regulator 3010*i* is moved to the first position the actuator of the accumulator 132 can be directly actuated which then causes hydraulic fluid to move along conduit 3017*i* to open or close a wellhead control mechanism 3008*i*.

As will be appreciated by those skilled in the art, the system 3000 can regulate more than one wellhead control mechanism 3008 of one or more wellheads 902. As such, the one or more conduits 3013 can comprise further conduits $\mathbf{3013}_2$ and $\mathbf{3013}_n$. The subscript "n" is used to denote that there is no predetermined limit on the number of further components that form part of the system 3000. Further conduits $\mathbf{3013}_{2\text{-}n}$ can conduct power fluid from the power source 3006 to the valve actuation panel 3004. The valve actuation panel 3004 can comprise further switches $\mathbf{3007}_{2\text{-}n}$ that control the open and closed position of further valves $\mathbf{3009}_{2\text{-}n}$. The system 3000 can also comprise further conduits $\mathbf{3015}_{2\text{-}n}$ that conduct the power from the open valves $\mathbf{3009}_{2\text{-}n}$ to further valve position regulators $\mathbf{3010}_{2\text{-}n}$ to regulate the actuation of further valves 30082-*n*.

As shown in FIG. 10, the system 3000 can also comprise one or more conduits 30153 that conduct power fluid from the valve actuation panel 3004 directly to a valve position regulator $\mathbf{3010}_3$ that is not part of the accumulator 132. The valve position regulator 30 K may regulate the actuation of one or more further wellhead control mechanisms $\mathbf{3008}_3$, for example of one or more wellhead valves and/or one or more zipper manifold valves 923.

Figure 11:
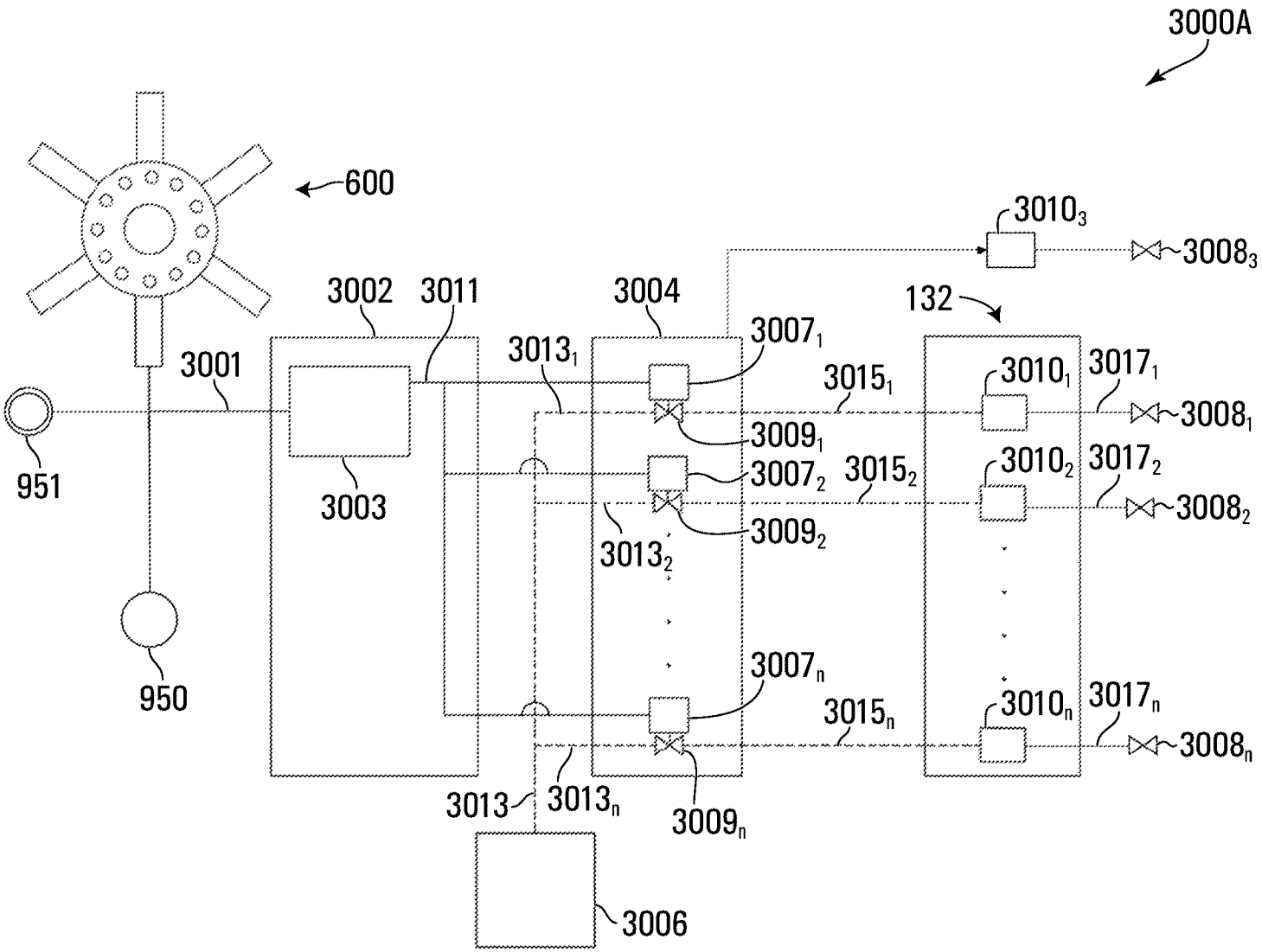
FIG. 11 is an example of a schematic that represents another embodiment of the present disclosure for regulating one or more wellhead control mechanisms of one or more wellheads.

FIG. 11 is a schematic that represents a system 3000A that comprises similar, if not the same components described above in respect of system 3000. The primary differences between the two systems 3000, 3000A is that the system 3000A further comprises a controller circuit 3003 and one or more of the sensors 600, 950 or 951. The one or more sensors 600, 950, 951 are operatively coupled with the controller circuit 3003, which may be housed within a housing 3002 or not. When employed, the housing 3002 protects the controller circuit 3003 from the elements and conditions at or near the well pad 900.

As described herein above, the one or more sensor assemblies 600 can comprise any type of sensor that can detect the presence of an object that is within a given section of the wellhead 902A or wellhead 902B. The one or more sensors 950 can provide fluid-based sensory information regarding the pressure and/or fluid flow rates within one or more fluid conducting conduits on the portion of the well pad 900. As will be appreciated by those skilled in the art, the one or more sensors 950 may detect fluid flow and/or changes in fluid flow within the one or more fluid conducting conduits. As described above, the one or more sensors 951 can also provide well-operation tool derived sensory information.

As described further herein below, the controller circuit 3003 is configured to receive the sensory information from the one or more sensors 600, 950.951 by a wired signal transmission means or a wireless signal transmission means (collectively shown as 3001 in FIG. 11). Upon receiving the sensory information, the controller circuit 3003 will process the sensory information and then generate a command signal that is communicated to one or more of the switches collectively referred to as 3007 that may be housed within the valve actuation panel 3004. The command signal can cause the one or more switches 3007 to actuate and regulate the actuation of one or more of the valves 3009 described herein above. For example, if any of the sensory information indicates that there is an object present within the wellhead, for example from sensor 600 or sensor 951, or that there is a pressure scenario within the portion of the well pad 900 that would make it unsafe to open or close a valve or that there is a well-operation tool that is at a depth within the well where it would be unsafe to actuate a control mechanism of the portion of the well pad 900, then the controller circuit 3003 will send a command signal that causes the one or more switches 3007 to actuate so that none of the one or more valve position regulators 3010 can move from the second position into the first position. Alternatively, if the one or more valve position regulators 3010 are already in the second position, the controller circuit 3003 will either send a no-change command signal or the controller circuit 3003 will not send any command signal so that the control mechanisms remain in the locked state. In the event that the sensory information changes to indicate that there is no object detected within the wellhead or that the pressure scenario is safe to open a valve or that the well-operation tools have been removed from the wellhead, then the controller circuit 3003 may send a command signal to the cause the one or more switches 3007 to actuate so that one or more of the one or more valve position regulators 3010 can move from the second position into the first position. When the valve position regulators 3010 are moved into the second position, then one or more of the wellhead control mechanism 3008 are unlocked and they can be actuated.

Figure 12A:
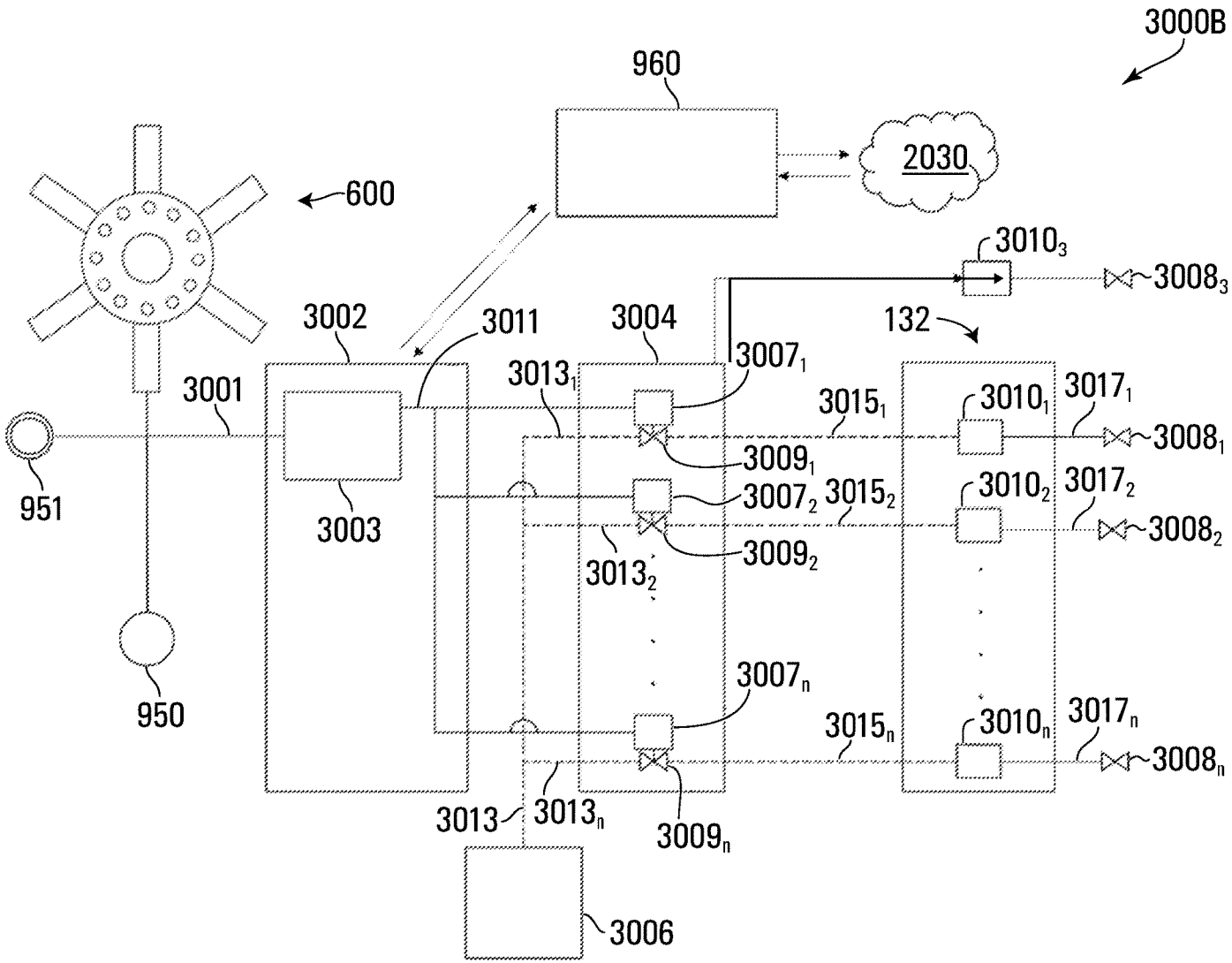
Figure 12B:
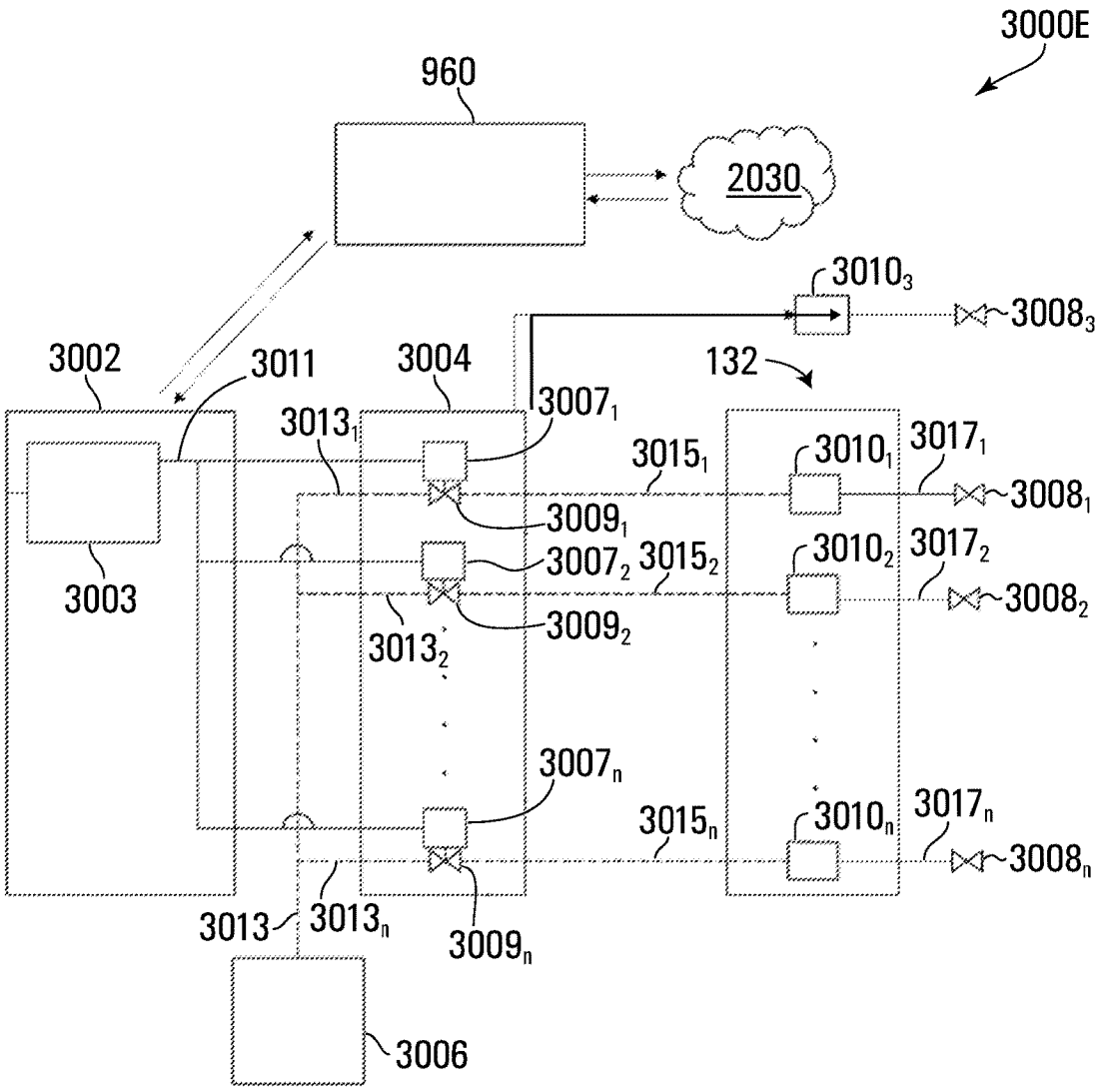
FIG. 12B shows another embodiment.

FIGS. 12A and 12B show two examples of further systems according embodiments of the present disclosure. FIG. 12A shows a schematic that represents a system 3000B that comprises similar, if not the same, components described above in respect of system 3000A. The primary differences between the two systems 3000A, 3000B is that the system 3000B further comprises a user interface 960 that may act as a user interface that is operatively coupled with the control circuit 3003 by a wired or wireless connection that permits the transmission of information therebetween. In some embodiments of the present disclosure, the control circuit 3003 can generate a display signal that represents the received sensory information. In some embodiments of the present disclosure, the user interface 960, under control of a user, may send a command signal to the control circuit 3003 to regulate the actuation of one or more of the valve position regulators 3010, as described herein above. As described herein further below, in some embodiments of the present disclosure, the user interface 960 can participate in an optional handshake protocol 2030 (as described further hereinbelow) that regulates the ability of the user interface 960 to direct, by sending commands to, the control circuit 3003 or the ability of the controller circuit 3003 to direct, by sending commands to, any switches 3007, so that a valve-position regulator 3010 will only move between the first position and second position if the requirements of the handshake protocol are satisfied.

In some embodiments of the present disclosure, the user can use any or all of the sensory information to determine when one or more valves on the portion of the well pad 900 should be locked in a given position or unlocked so as to permit the wellhead control mechanism 3008 to be actuated between an open and a closed position.

FIG. 12B shows a schematic of another system 3000E that comprises similar, if not the same, components described above in respect of the system 3000B. The primary differences between the two systems 3000B, 3000E is that the system 3000E does not include the sensory information from the one or more sensors 600, 950, 951 by a wired signal transmission means or a wireless signal transmission means (as shown in FIG. 12A). In using the system 3000E, the user may rely on other well pad protocols to determine when to send a command to the controller circuit 3003 to actuate one or more of valves 3009.

As will be appreciated by those skilled in the art, other embodiments of the present disclosure may relate to a system that includes the user interface 960, a valve actuation panel 3004 and the accumulator 132, all as described above, and the user interface 960 is configured to regulate the position of the one or more switches 3007 and/or the position of one or more valves 3009 without the sensory information 3001 or the controller circuit 3003.

Figure 13A:
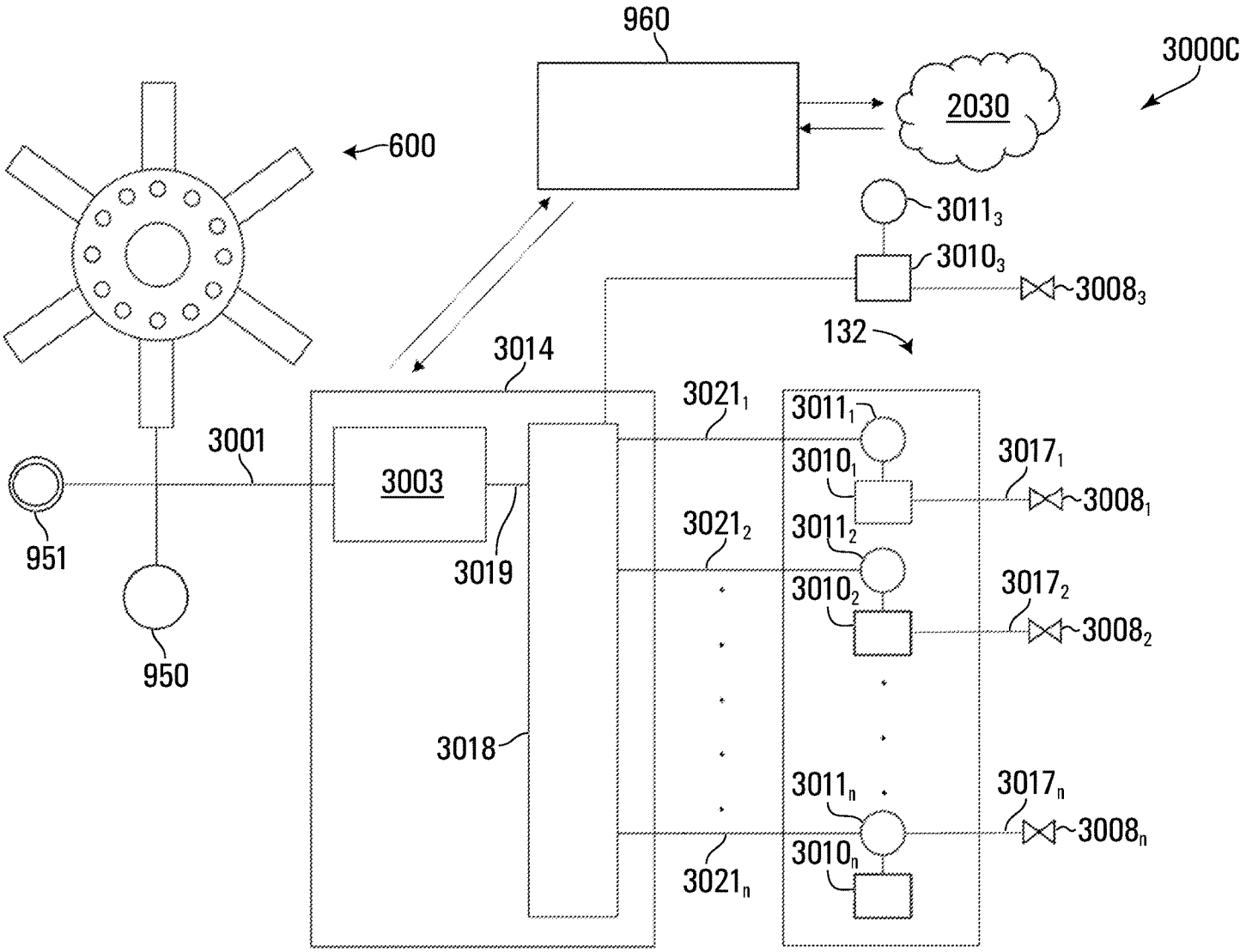
Figure 13B:
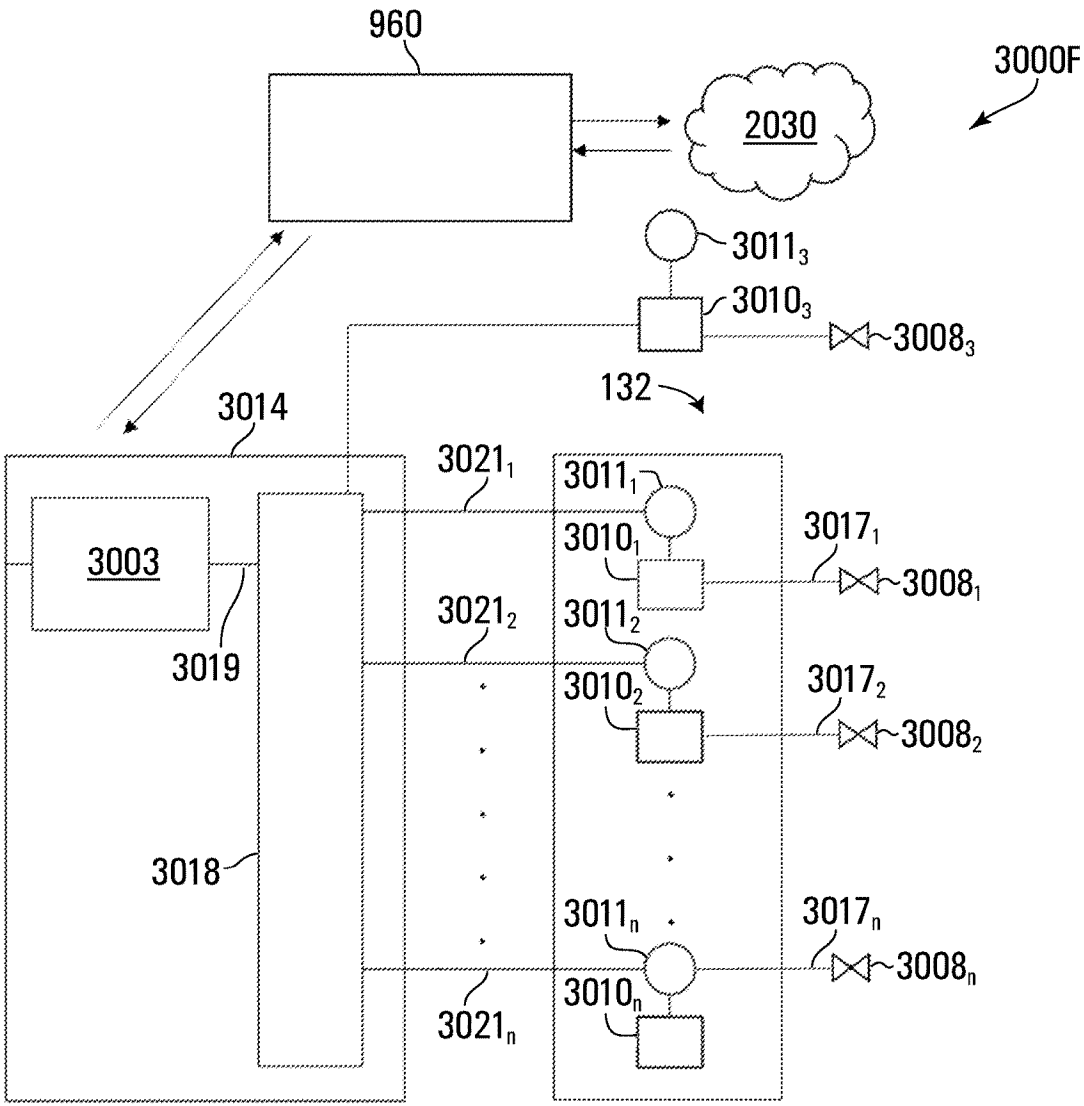
FIG. 13B shows another embodiment.

FIGS. 13A and 13B show two examples of two systems according to embodiments of the present disclosure. FIG. 13A shows a schematic of a system 3000C that comprises similar, if not the same, components described above in respect of system 3000B. The primary differences between the two systems 3000B, 3000C is that the system 3000C does not include a hydraulically or pneumatically powered valve actuation panel 3004. Instead the system 3000C is electrically powered and it comprises an electronic switch panel 3018 that may be housed within a housing 3014 that may also house the controller circuit 3003. The controller circuit 3003 and the electronic switch panel 3018 may be operative coupled by a conduit 3019 that can transmit command signals therebetween. The electronic switch panel 3018 comprises one or more hardware components operatively connected in one or more buses, such components include, but are not limited to one or more: relays, transformers, fuses, breakers, optional heater units, inputs for an electronic power source (not shown), and communication sections. The one or more communication sections are configured for wireless communication, Ethernet communication, fiber optic communication and all other types of applicable communication protocols.

In some embodiments of the present disclosure, the electronic switch panel 3018 may also include a further controller circuit (not shown) that allows operative connection with one or more further electronic switch panels 3018 so that two or more electronic switch panels 3018 can be operatively coupled together, for example in a daisy chain, to provide modularity and to increase the number of valve position regulators 3010 that can be regulated by the system 3000C.

The electronic switch panel 3018 is configured to be operatively coupled to one or more actuators 3011 upon the accumulator 132 via one or more conduits 3021. The one or more actuators 3011 can each be an electronic motor or a solenoid that is operatively coupled to the moveable member of each of one or more valve position regulators 3010. For example, if the sensory information communicates to the controller circuit 3003 that it is safe to actuate a valve 3008*i*, the controller circuit 3003 may send a command signal to the electronic switch panel 3018, which in turn communicates a command signal, via a conduit 3021, to an actuator 3011 to move the moveable body of the valve position regulator 3010*i* from the second position to the first position. When the moveable body is in the first position, the valve actuator of the accumulator 132 can be directly actuated to actuate the wellhead control mechanism 3008*i*.

FIG. 13B shows a schematic of another system 3000F that comprises similar, if not the same, components described above in respect of system 3000C. The primary differences between the two systems 3000C. 3000F is that the system 3000F does not include the sensory information 3001 from the one or more sensors 600, 950, 951 by a wired signal transmission means or a wireless signal transmission means (as shown in FIG. 13A).

As will be appreciated by those skilled in the art, other embodiments of the present disclosure may relate to a system that includes the user interface 960, an electronic switch panel 3018 and the accumulator 132, all as described above, and the user interface 960 is configured to regulate the position of the one or more switches 3007 and/or the position of one or more valves 3009 without the sensory information 3001 or the controller circuit 3003.

Figure 14:
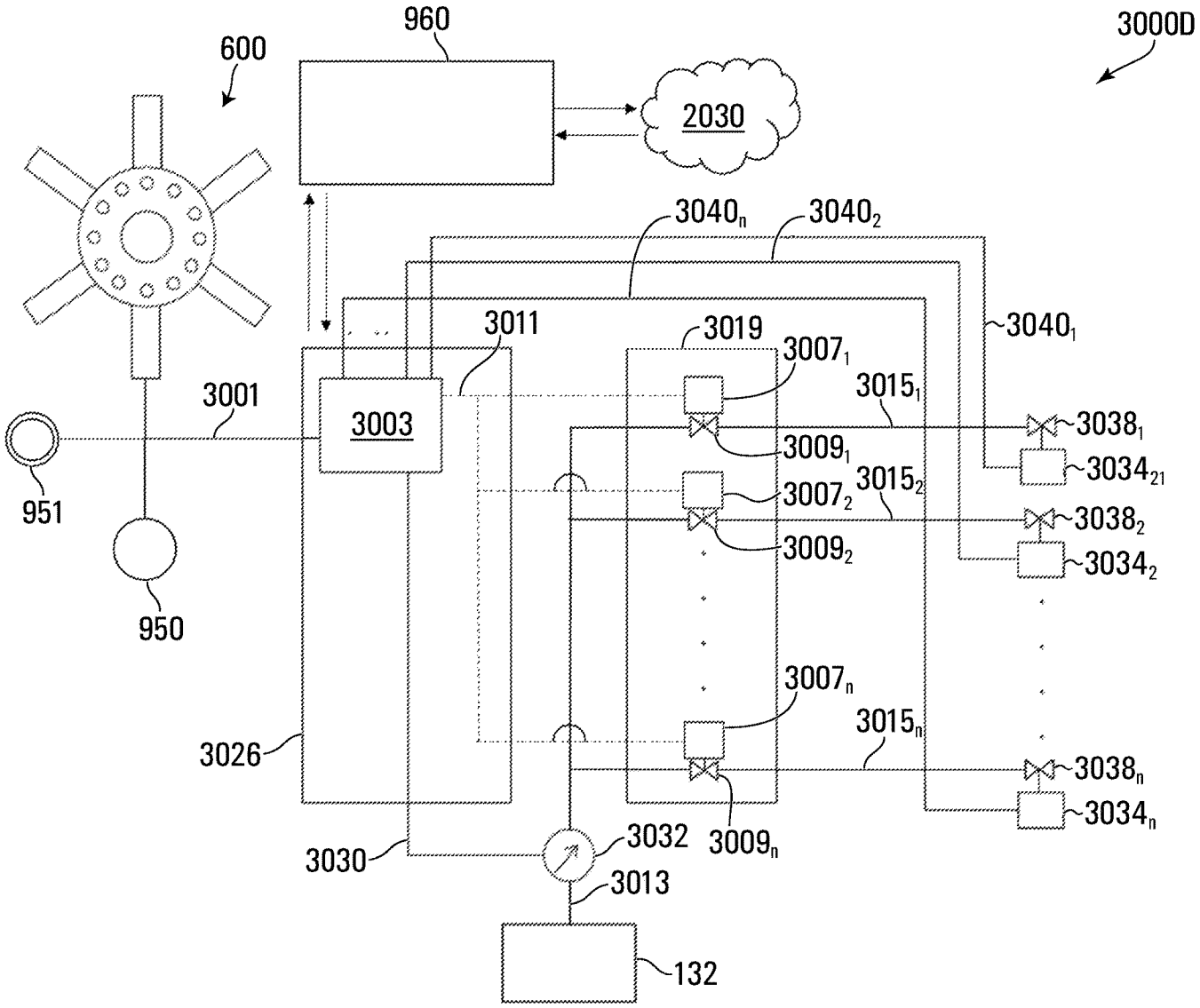
FIG. 14 is an example of a schematic that represents another embodiment of the present disclosure for regulating one or more wellhead control mechanisms of one or more wellheads.

FIG. 14 is a schematic that represents a system 3000D that comprises similar, if not the same, components described above in respect of system 3000C. The primary differences between the two systems 3000C. 3000D is that the system 3000D does not include valve position regulators 3010 that physically interfere with a direct and physical actuation of an actuator on the accumulator 132. Instead, the system 3000D provides direct control over one or more wellhead control mechanisms 3038 that are incorporated into one or more wellheads or into fracturing conduits on a well pad.

As described above, the controller circuit 3003 can receive sensory information from one or more sensors 600, 950, 951 which the controller circuit 3003 uses to assess whether or not it is safe to actuate one or more of the wellhead control mechanisms 3038. In the event that the controller circuit 3003 determines that it is safe to actuate one or more of the wellhead control mechanisms 3038, for example wellhead control mechanism 3038*i*, the controller circuit 3003 will generate a command signal that is transmitted via a conduit 3011 to a switch box 3019 that houses an actuator 3007*i*. Upon receipt of the command signal the actuator 3007*i* can actuate a valve 3009*i*. The valve 30091 will allow the passage of a power fluid from a source 132, which provides either pneumatic power fluids or hydraulic power fluids. Upon actuation of the valve 3009*i*, the power fluid can flow along conduit 3015*i* and directly actuate the wellhead control mechanism 3038*i*.

In some embodiments of the present disclosure, in place of or in addition to the power fluid provided by the source 132, the controller circuit 3003 of the system 3000D can directly actuate the one or more wellhead control mechanisms 3038 via one or more conduits 3040 and one or more actuators 3034. For example, based upon the received sensory information, the controller circuit 3003 may generate a command signal that is communicated to an actuator 3034*i* via a conduit 3040*i*. The actuator 3034*i* can be an electronic motor, solenoid or other similar electronic device that can directly actuate the position of the wellhead control mechanisms 3038*i* between an open and a closed position. In the event that the controller circuit 3003 determines from the received sensory information that it is not safe to open or close one or more of the one or more wellhead control mechanisms 3038, then the controller circuit 3003 will either send a no-change command signal or the controller circuit 3003 will not send any command signal so that the one or more wellhead control mechanisms 3038 do not move and are locked.

As will be appreciated by those skilled in the art, other embodiments of the present disclosure may relate to a system that includes the user interface 960 that is configured to provide direct control over one or more wellhead control mechanisms 3038, for example via one or more of actuator 3034.

Figure 15:
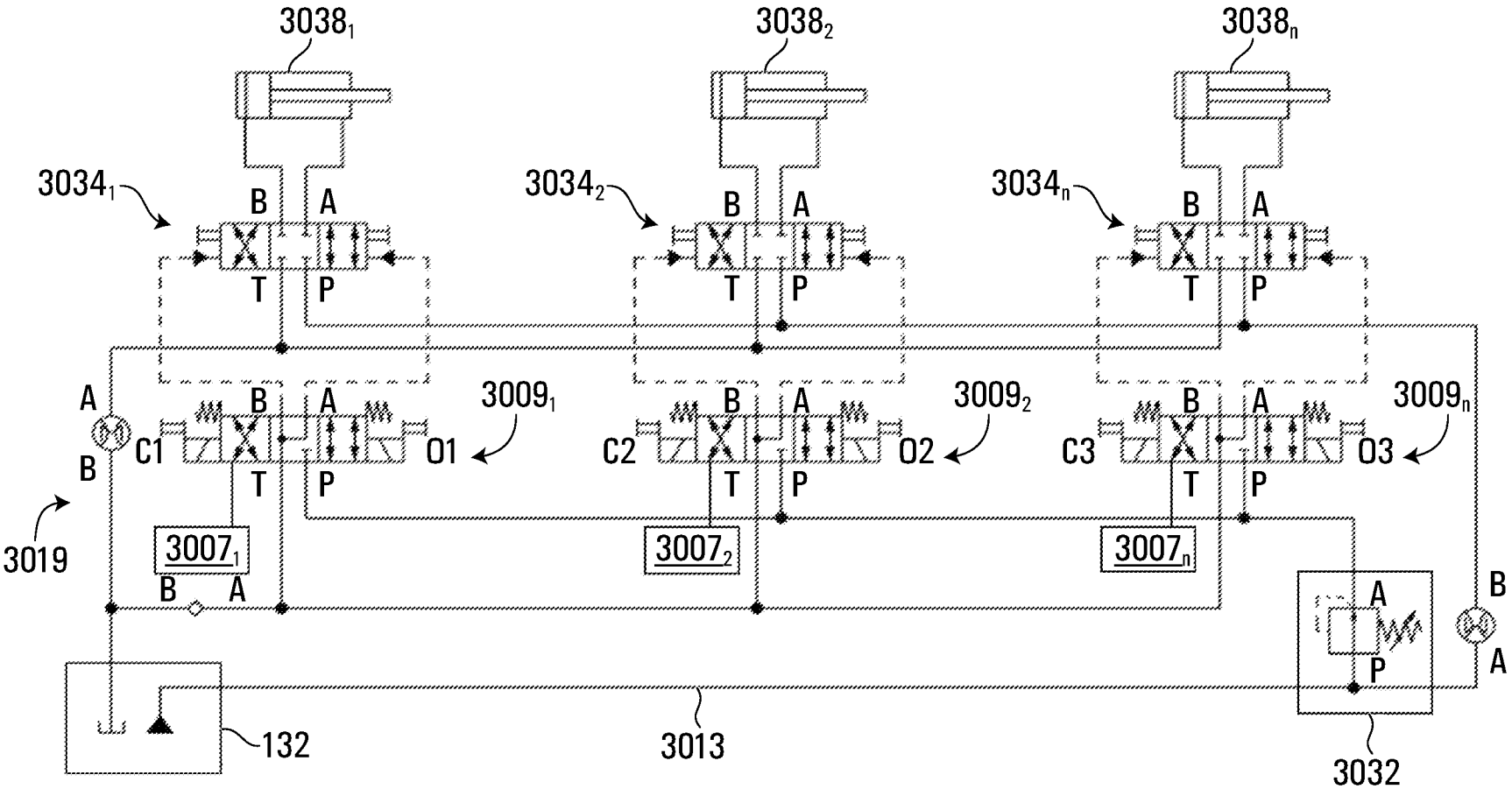
FIG. 15 is an example of a schematic that represents a hydraulic circuit that may be used in one or more embodiments of the present disclosure for regulating three one or more wellhead control mechanisms.

FIG. 15 is a schematic that represents an example of a valve control system that comprises a portion of the system 3000D. As shown, the accumulator 132 can provide hydraulic power via conduit 3013 to a switch 3032 that is configured to direct at least a portion of the hydraulic power to one or more of valves 3009 (3009*i*, $\mathbf{3009}_2$, $\mathbf{3009}_n$ are shown) the position of which are controlled by one or more of the switches 3007 (3007*i*, $\mathbf{3007}_2$, $\mathbf{3007}_n$ are shown). The position of the one or more valves 3009 dictates the flow of hydraulic power to one or more actuators 3034 (3034*i*, 30342, $\mathbf{3034}_n$ are shown) and turn this can regulate the position of one or more wellhead control mechanisms 3038 (3038*i*, $\mathbf{3038}_2$, $\mathbf{3038}_n$ are shown).

Figure 16:
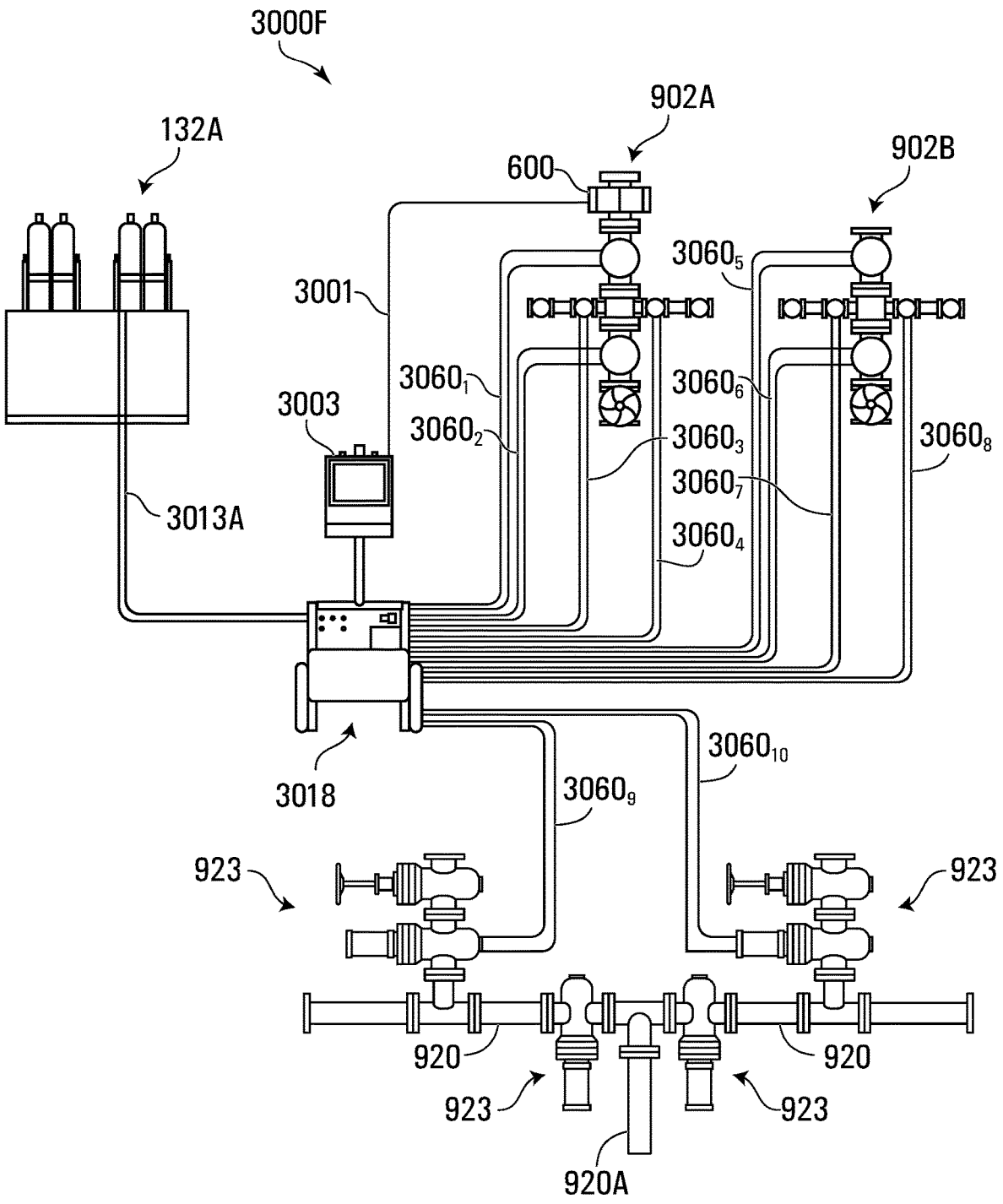
FIG. 16 shows an example of a controller circuit, according to one or more embodiments of the present disclosure, for regulating wellhead control mechanisms of two wellheads.

FIG. 16 depicts another example of a system 3000F that is configured to receive hydraulic power from an accumulator 132A, via a conduit 3013 A and for regulating the position of one or more wellhead control mechanisms on one or more wellheads 902 (902A and 902B are shown). The system 3000F comprises a controller circuit 3003 (as described herein), a valve actuation panel 3004 (as described herein) and a series of conduits 3060 that conduct hydraulic fluid to one or more wellhead control mechanisms on one or more of the well heads 902A and/or 902B or a valve 923 on a fracking fluid conduit system. As shown in FIG. 16, the controller circuit 3003 can receive sensory information via a conduit 3001 from a sensor assembly 600 or sensor 951 to indicate whether or not there may be an object present within the well head 902A. The person skilled in the art will appreciate that the system 3000F may also comprise further sensors (such as further sensors 600, 950 or 951, or any combination thereof, as described herein above) to provide sensory information to the controller circuit 3003. Based upon the sensory information received, the controller circuit 3003 may direct hydraulic fluid received from the accumulator 132A to wellhead 902A along anyone of conduit 3060*i* to a crown valve, a conduit $\mathbf{3060}_2$ to a master valve or a conduit 3060*s* and/or a conduit $\mathbf{3060}_4$ to either or both of a lateral valve. The controller circuit 3003 may also direct hydraulic fluid to wellhead 902B (or any other wellhead that may be present on the applicable well pad) via a conduit 3060*s* to a crown valve, a conduit 3060*s* to a master valve or a conduit $\mathbf{3060}_7$ and/or a conduit $\mathbf{3060}_8$ to either or both of a lateral valve. The controller circuit 3003 may also direct hydraulic fluid to one or more of valves 923 on a fracking fluid conduit system that comprises at least conduits 920 and 920A. The flow of hydraulic fluid to the one or more wellhead control mechanisms described above provides direct control over said valves because it causes the valves to actuate between a first position and a second position to regulate the flow of fluids through, to or from at least the wellheads 902A and 902B.

Those skilled in the art will appreciate that the system 3000F can be retrofit onto an existing well pad without having to add any valve position regulators onto the accumulator 132A. Instead, the hydraulic fluid is pressurized and conducted to the valve actuation panel 3004 which can then direct the flow of hydraulic fluid, under the control of the controller circuit 3003, to directly actuate one or more of the applicable valves. Those skilled in the art will also appreciate that the accumulator 132A may also be a source of pneumatic power or a source of electrical power and the one or more conduits 3060 are configured accordingly to conduct pneumatic power fluid or electrical power. In the case of electrical power, the valve actuation panel 3004 is replaced with an electronic valve panel 3018 and the applicable wellhead control mechanisms directly are electronically actuated.

Figure 17A:
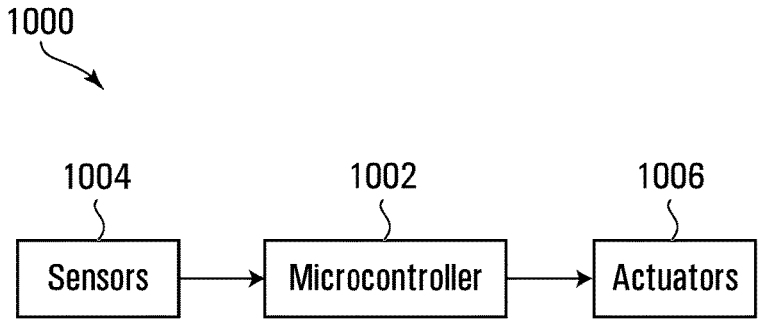
Figure 17B:
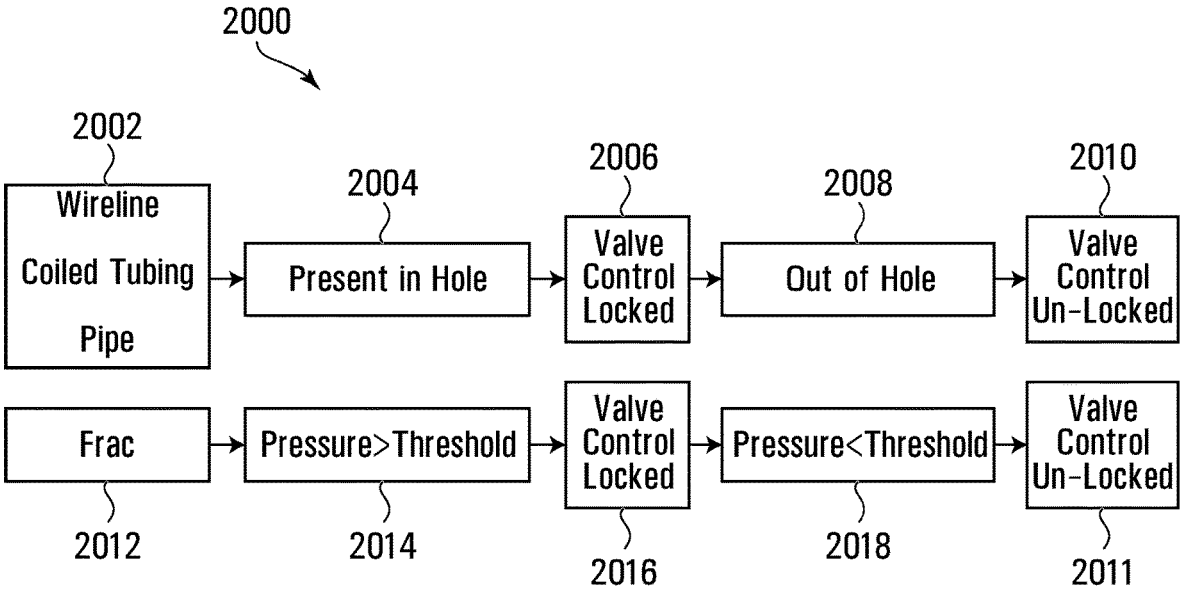

FIGS. 17A and 17B shows a hardware structure and a logic flow-chart that can be used in an embodiment of a well pad control system for regulating the use of one or more valve-position regulators (as described herein above). As shown in FIG. 17A, the system in this embodiment comprises a microcontroller 1002, which generally comprises one or more control circuits (referred to as controller circuit 3003 above) that are configured to receive sensory information (including data) from one or more sensor assemblies 1004 such as sensor assemblies 504, 600, 950 and/or 951, to obtain fluid-based information and/or object-based information, and controlling one or more actuators 1006 such as the actuators of the valve-position regulators 210, 310, and/or 410 that are operatively coupled to a wellhead control mechanism or the actuators 1006 may directly actuate wellhead control mechanism, for example via one or more of actuators 3034.

The microcontroller 1002 may comprise a processing structure coupled to a memory and one or more input/output interfaces for communicating with the one or more sensor assemblies 1004 and the one or more regulators 1006. The microcontroller 1002 may execute a management program or an operating system (e.g., a real-time operating system) for managing various hardware components and performing various tasks.

As shown in FIG. 17B, when well operation 2002 is being performed on a wellhead and some form of object is detected as being present in hole 2004, such as a well-operation tool is in the well, as determined by the sensor data received from one or more sensor assemblies 1004, then the microcontroller 1002 controls some or all of the valve-position regulators 1006 on a given wellhead to move to and/or keep in a locked position 2006 so that the position of all valves on the given wellhead cannot be changed while a tool is present in the well. When the tool is removed from the well, out of hole 2008, as determined by the sensor data received from sensor assemblies 1004, then the microcontroller 1002 controls the valve-position regulators to move to the unlocked position 2010 and one or more valves on the wellhead can then be actuated directly. Examples of the operation 2002 include well-operations, as described herein.

If there is a hydraulic fracturing operation 2012 being performed on a given wellhead and one or more sensors 950 detects a change in fluid pressure (or fluid flow as the case may be) within a given conduit, such as the input conduit 922, that is greater than a threshold value 2014, then some or all of valve-position actuators 1006 on the wellhead can be moved to and/or kept in a locked position 2016 so that the position of all valves on the wellhead cannot be changed while there is a hydraulic fracturing operation being performed on the given wellhead. In some embodiments of the present disclosure, if the fluid pressure detected by pressure sensor 950A at the zipper manifold 920 is about equal to a fluid pressure detected at the input conduit 922 of the wellhead 902A, then that is one indicator that wellhead 902A is receiving the fracturing operation 2012. When the pressure detected is less than the threshold 2018, the valves may be unlocked 2011 and actuated directly.

Alternatively, the system may not include a user interface or any sensors to provide either fluid-based information or object-based information. Rather, the system may rely on an operator's observations to make proper determinations. For example, when the operation 2002 is being performed on a wellhead and—based upon the operator's observations—a tool is determined to be in the well then some or all valve-position regulators on the given wellhead can be moved to and/or kept in a locked position so that the position of all valves on the given wellhead cannot be changed while a tool is in the well. When the tool is removed from the well, then the valve-position regulators can be moved to the unlocked position and one or more valves can be actuated.

Figure 18A:
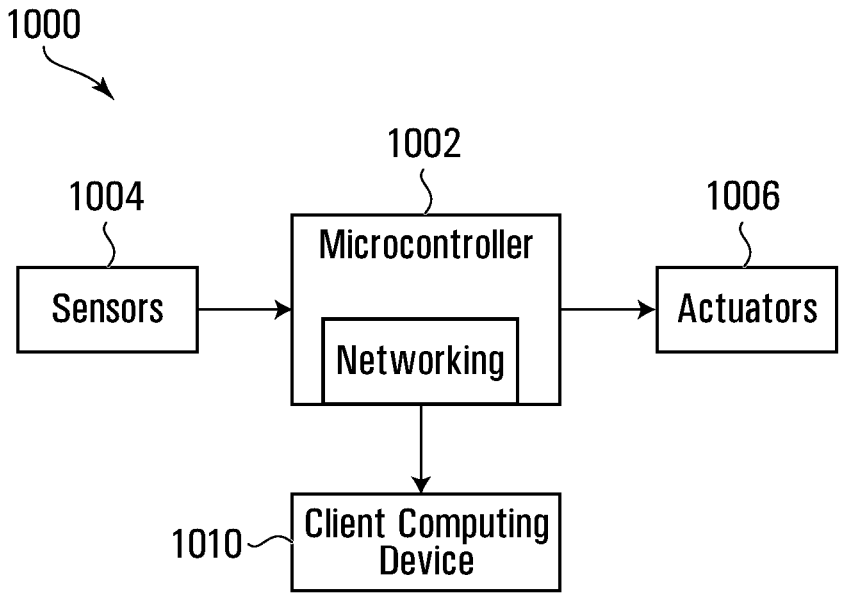
Figure 18B:
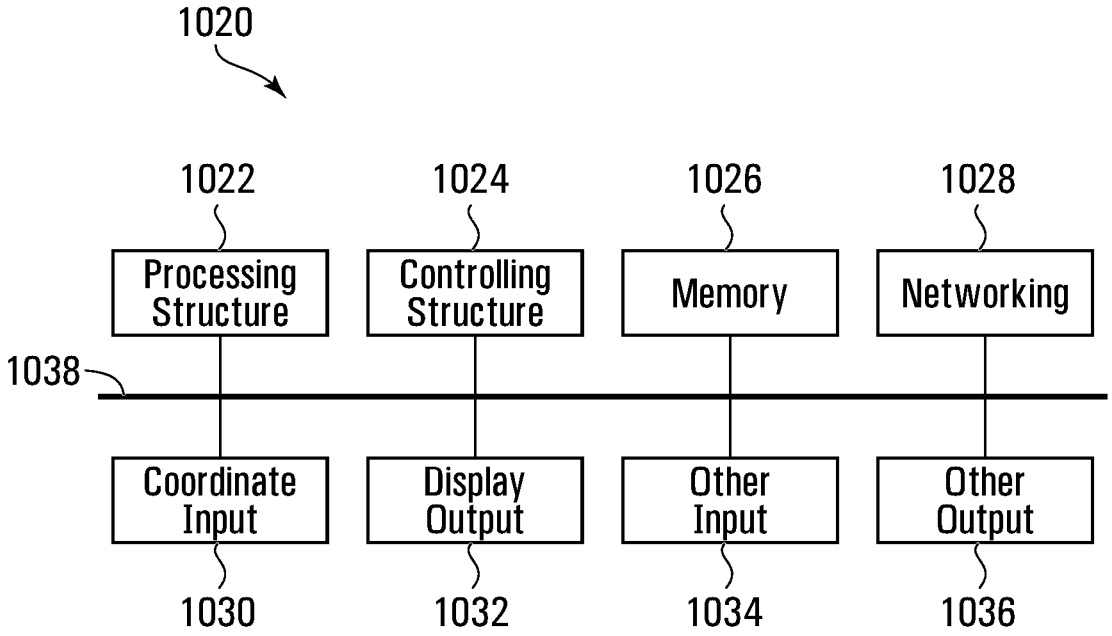
FIG. 18B shows an example of a hardware structure of a microcontroller circuit and/or a computing device of the system.

FIGS. 18A and 18B show a hardware structure and a software structure of the system according to some embodiments of the present disclosure.

Compared to the embodiments shown in FIG. 17A, the microcontroller 1002 in the embodiments depicted in FIGS. 18A and 18B further comprise a networking module 1008 for communicating with one or more user interfaces or client computing devices 1010 such as desktop computers, laptop computers, tablets, smartphones. Personal Digital Assistants (PDAs) and the like, all of which may be the user interface 960 described above, through a network (not shown) such as the Internet, a local area network (LAN), a wide area network (WAN), a metropolitan area network (MAN), and/or the like, via suitable wired and wireless networking connections. In embodiments that the microcontroller 1002 is in communication with a variety of sensor assemblies 1004 and regulators 1006 and performs sophisticated applications, the microcontroller 1002 may have sophisticated hardware and software structure and may be considered a server computer.

While the hardware and software structure of the microcontroller 1002 generally has features and functionalities more suitable for real-time processing, in various embodiments, the microcontroller 1002 may have a hardware and software structure similar to the client computing device 1010, or may have a simplified hardware and software structure compared thereto.

As shown in FIG. 18B, generally, the microcontroller 1002 and the client computing device 1010 may comprise a processing structure 1022, a controlling structure 1024, memory or storage 1026, a networking interface 1028, a coordinate input 1030, a display output 1032, and other input and output modules 1034 and 1036, all of which are functionally interconnected by a system bus 1038. Depending on the implementation, the microcontroller 1002 may not comprise all above-described components (e.g., the coordinate input 1030 and/or display output 1032) and may comprise other components that are suitable for well operations.

The processing structure 1022 may be one or more single-core or multiple-core computing processors such as INTEL® microprocessors (INTEL is a registered trademark of Intel Corp., Santa Clara. CA, USA). AMD® microprocessors (AMD is a registered trademark of Advanced Micro Devices Inc., Sunnyvale, CA, USA), ARM® microprocessors (ARM is a registered trademark of Arm Ltd., Cambridge. UK) manufactured by a variety of manufactures such as Qualcomm of San Diego, California, USA, under the ARM® architecture, or the like.

The controlling structure 1024 may comprise a plurality of controlling circuitries, such as graphic controllers, input/output chipsets and the like, for coordinating operations of various hardware components and modules of the controller circuit and the user interfaces.

The memory 1026 may comprise a plurality of memory units accessible by the processing structure 1022 and the controlling structure 1024 for reading and/or storing data, including input data and data generated by the processing structure 1022 and the controlling structure 1024. The memory 1026 may be volatile and/or non-volatile, non-removable or removable memory such as RAM. ROM, EEPROM, solid-state memory, hard disks. CD, DVD, flash memory, or the like. In use, the memory 1026 is generally divided to a plurality of portions for different use purposes. For example, a portion of the memory 1026 (denoted as storage memory herein) may be used for long-term data storing, for example, storing files or databases. Another portion of the memory 1026 may be used as the system memory for storing data during processing (denoted as working memory herein).

The networking interface 1028 comprises one or more networking modules for connecting to other computing devices or networks through the network by using suitable wired or wireless communication technologies such as Ethernet, WI FI®, (WI-FI is a registered trademark of Wi-Fi Alliance, Austin. TX. USA), BLUETOOTH® (BLUETOOTH is a registered trademark of Bluetooth Sig Inc., Kirkland, WA, USA), ZIGBEE® (ZIGBEE is a registered trademark of ZigBee Alliance Corp., San Ramon, CA, USA), 3G, 4G, 5G wireless mobile telecommunications technologies, and/or the like. In some embodiments, parallel ports, serial ports, USB connections, optical connections, or the like may also be used for connecting other computing devices or networks although they are usually considered as input/output interfaces for connecting input/output devices.

The display output 1032 may comprise one or more display modules for displaying images, such as monitors, LCD displays, LED displays, projectors, and the like. The display output 1032 may be a physically integrated part of the processor and/or the user interfaces (for example, the display of a laptop computer or tablet), or may be a display device physically separate from, but functionally coupled to, other components of the processor and/or the user interfaces (for example, the monitor of a desktop computer).

The coordinate input 1030 may comprise one or more input modules for one or more users to input coordinate data, such as touch-sensitive screen, touch-sensitive whiteboard, trackball, computer mouse, touchpad, or other human interface devices (HID) and the like. The coordinate input 1030 may be a physically integrated part of the processor and/or user interfaces (for example, the touch-pad of a laptop computer or the touch-sensitive screen of a tablet), or may be a display device physically separate from, but functionally coupled to, other components of the processor and/or user interfaces (for example, a computer mouse). The coordinate input 1030 may be integrated with the display output 1032 to form a touch-sensitive screen or touch-sensitive whiteboard.

The microcontroller 1002 and the client computing device 1010 may also comprise other inputs 1034 such as keyboards, microphones, scanners, cameras, and the like. The microcontroller 1002 and the client computing device 1010 may further comprise other outputs 1036 such as speakers, printers and the like. In some embodiments of the present disclosure, at least one processor and/or user interface may also comprise, or is functionally coupled to, a positioning component such as a Global Positioning System (GPS) component for determining the position thereof.

The system bus 1038 interconnects the various components described herein above enabling them to transmit and receive data and control signals to/from each other.

In some embodiments of the present disclosure, the system can be partially autonomous so that the information from the one or more sensors 1004, such as one or more fluid-pressure sensors, one or more fluid-flow sensors, a magnetic-based sensor assembly, a valve-position sensor, a well-operation tool position sensor and combinations thereof is sent to the microcontroller 1002. The microcontroller 1002 will then assess the sensory information received and compare that received information with other sensory information and/or operational information that may be stored on the microcontroller's memory 1026 or that may be received substantially contemporaneously. Based upon a series of memory saved instructions, the microcontroller 1002 may generate one or more valve-position regulator commands that are sent to one or more actuating systems to move the moveable body of one or more valve-position regulators from a locked position to an unlocked position or vice versa. Or the microcontroller 1002 may send one or more valve-position commands to one or more of the actuators 3034 to provide direct control of the wellhead control mechanisms. The system may also comprise an override functionality so that one or more users can override the one or more commands sent from the microcontroller 1002.

Figure 19A:
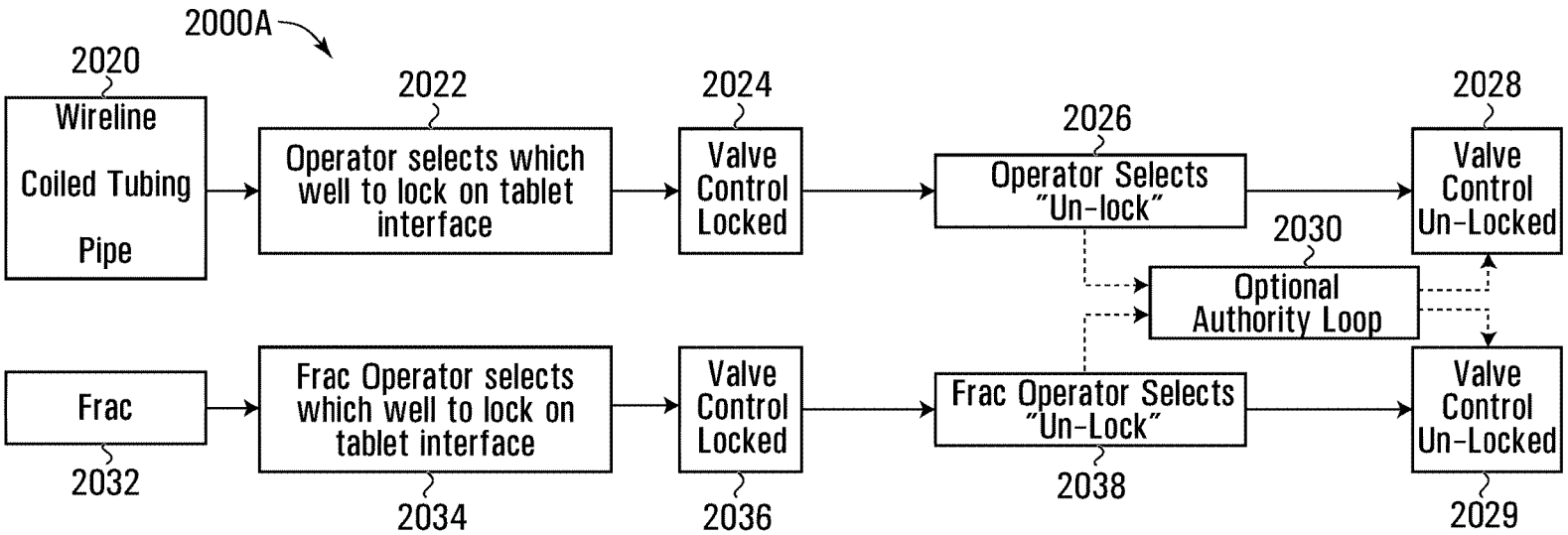

FIG. 19A is a logic flow-chart that can be used in an embodiment of a system that includes a user interface, such as a tablet computer, a mobile computer, a desktop computer and the like, that can be used to assist with regulating the position of one or more valve-position regulators that are operatively coupled to one or more valves upon the well pad 900 but there are no sensors included to provide either fluid-based information or object-based information to the user. The logic flow chart shows that during an operation (either a well workover operation 2020 or a frac operation 2032) the operator may select which well head 2022/2034 to control and then to lock the position of the associated valves 2024/2036 thereon. Before the operator can actually unlock 2028/2029 they may require an additional step of selecting the well valves to unlock 2026/2038 and proceed to wait for the requirements of a handshake protocol 2030 to be met. The handshake protocol 2030 requires that a group of individuals—or an individual with greater operational-authority over the operation of the well pad—is required to confirm that one or more valve-position regulators can be moved into the unlocked position 2028/2029 or that the wellhead control mechanisms can be directly controlled and actuated for example via one or more of actuators 3034. In order to so, each individual must actively engage the system, typically through their own user interface, or otherwise, to send a confirmatory signal. When the controller circuit 3003 or a master user interface 960 (as the case may be) receives all required confirmatory signals, the requirements of the handshake protocol 2030 are met. The user can utilize control features of the user interface 960 to move one, some or all of the valve-position regulators by controlling the body actuator of each valve-position regulator or the one or more of actuators 3034. For example, the user interface 960 can be a computer that can send operational directions to a hydraulic pump, a pneumatic pump and/or an electronic motor for moving the moveable body of each valve-position regulator to and between the first and second positions. Alternatively, the user interface can indicate when it is safe for a valve-position regulator to be moved manually to and between the first and second positions. As a further alternative, the user interface can generate a command to directly actuate one or more wellhead control mechanisms via one or more of the actuators 3034.

Figure 19B:
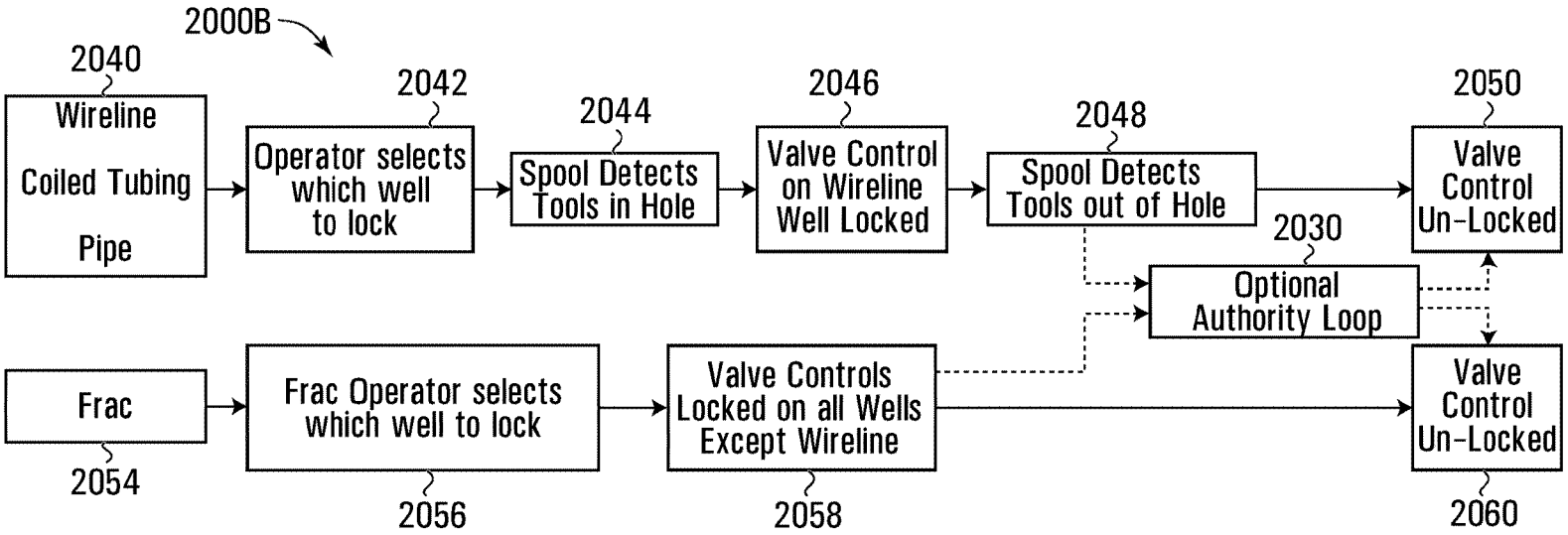
FIG. 19B shows an example of steps in a process that relate to information provided by a sensor assembly and a step of manually selecting a well; and, FIG. 19C shows an example of steps in a process that relates to the steps shown in FIG. 19B and information provided by one or more pressure sensors.

FIG. 19B is a logic flow-chart that that can be used in an embodiment of a system that includes a user interface that can assist with regulating the position of one or more valve-position regulators that are operatively coupled to one or more wellhead control mechanisms upon the well pad 900 or the user interface and direct one or more of the wellhead control mechanisms via one or more of the actuator 3034. The system includes at least one object-based sensor 600 or sensor 951 for providing object-based information to the user through the user interface. For example, during an operation (such as a well workover 2040 or a fracking operation 2054) the operator can select which well 2042/2056 to lock the applicable wellhead control mechanisms and if the object-based information indicates that there is a tool in hole 2044 the applicable wellhead control mechanisms will remain locked 2046. Only when the tool is detected as being out of the hole 2048, based upon the object-based information, the applicable wellhead control mechanisms can be unlocked 2050. Optionally, the handshake protocol 2030 may be implemented before any applicable wellhead control mechanisms can be unlocked when the handshake protocol 2030 conditions are met. In some embodiments of the present disclosure, if there is only object-based information being sent to the user interface, then the wells that are not selected and that may be receiving an operation 2054, those wells may all be locked until unlocked 2060, optionally subject to the handshake protocol 2030 conditions being met.

Figure 19C:
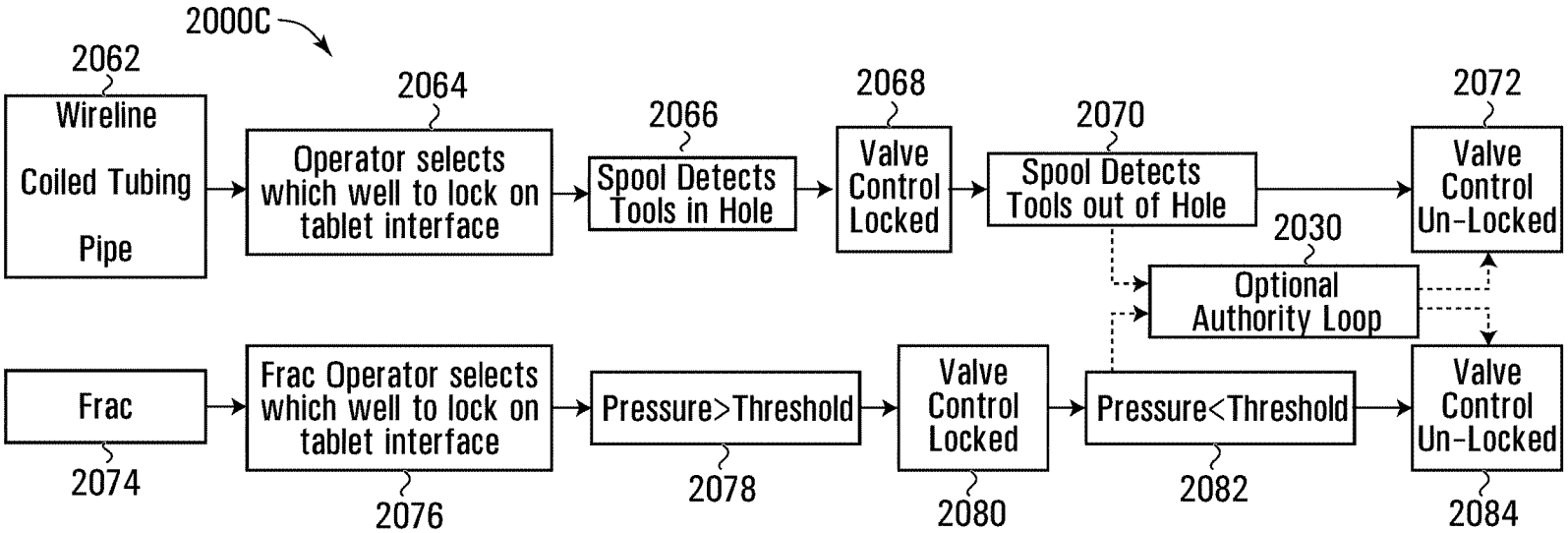

FIG. 19C is a logic flow-chart that can be used in an embodiment of the present disclosure that includes the same features as FIG. 19B but with the added benefit of one or more pressure sensors providing pressure-based information so that during a frac operation 2074 if the pressure is detected as being greater than the threshold 2078 in a well that is receiving a frac operation 2074, the valves are locked 2080 until such time that the pressure is detected as being less than the threshold 2082. Then the valves may be unlocked 2084, optionally subject to the authority loop 3020 conditions being met. During another well workover operation 2062 the steps 2064, 2066, 2068, 2070 and 2072 may be the same as described above regarding FIG. 19B.

Figure 19D:
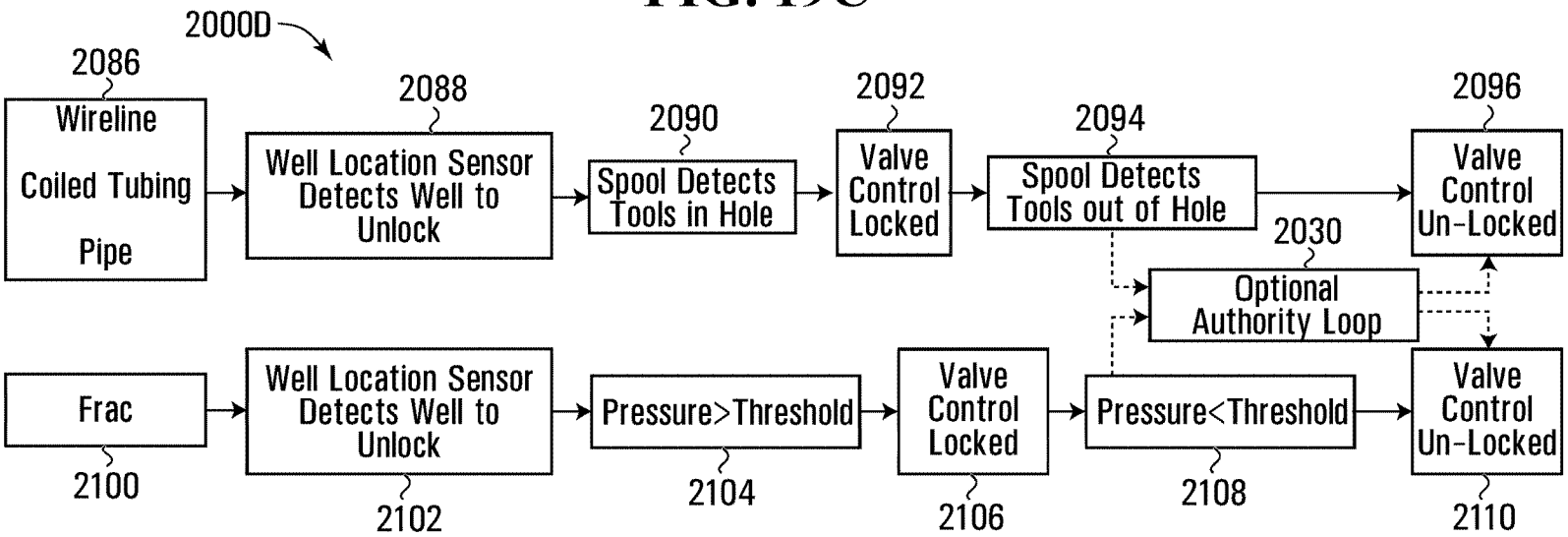
FIG. 19D shows an example of steps in a process that relates to the steps shown in FIG. 19C with and information provided by one or more well identifiers, according to embodiments of the present disclosure.

FIG. 19D is a logic flow-cart that can be used in an embodiment of a well pad control system that includes a user interface that can assist with regulating the position of one or more valve-position regulators that are operatively coupled to one or more valves upon the well pad 900. This system includes at least one pressure sensor 950 for providing pressure-based information and at least one sensor array 600 for providing object-based information to the user through the user interface. The system also includes at least one well head identifier 500. During an operation (such as a well workover operation 2086 or a frac operation 2100) the well location sensor can be positioned to allow the user to detect 2088/2102 which well is receiving the applicable operation. If there is a well operation occurring and the object-based information indicates that there is a tool in hole 2090 then the valves will all be locked, directly or indirectly, in position 2092 until the object-based information indicates that the tool is out of the hole 2094 and the applicable wellhead control mechanisms may be unlocked, optionally subject to the handshake protocol 2030 conditions being met. If there is a frac operation 2100 occurring and the fluid-based information indicates that the selected wellhead is receiving pressurized frac fluids, by the pressure being greater than the threshold 2104, then the applicable wellhead control mechanisms are locked in position 2106 until such time that the fluid-based information indicates that the pressure is lower than the threshold 2108 and the valves can be unlocked 2110, optionally subject to the handshake protocol 2030 conditions being met.

Figure 20:
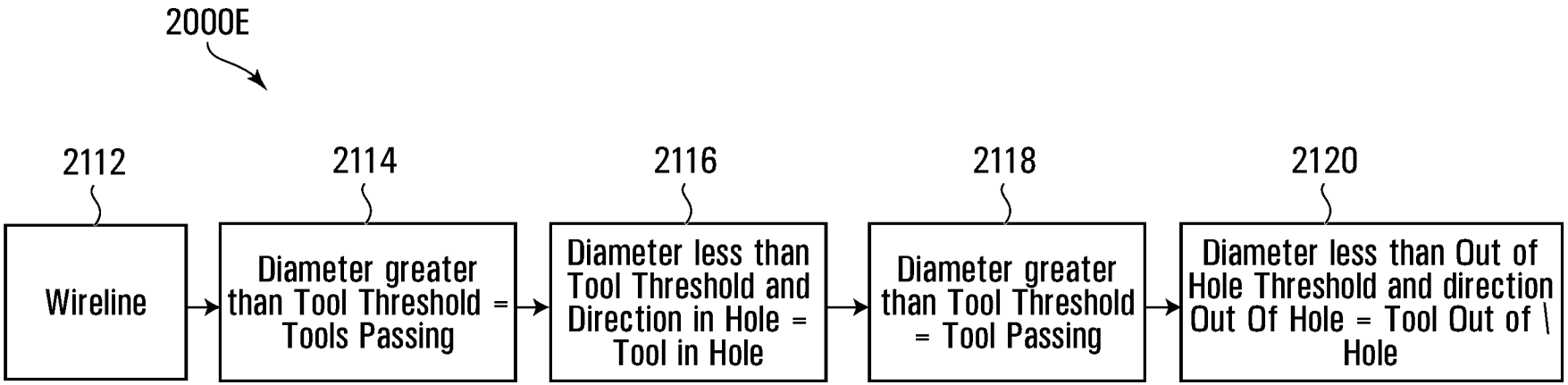
FIG. 20 is a schematic that represents an example of a process, according to embodiments of the present disclosure, for moving a lockout mechanism between the locked position and the unlocked position for use with non-magnetic, wireline-supported tools.

FIG. 20 is a logic flow-chart that can be used in an embodiment of a system when a non-ferromagnetic object, for example stainless steel wireline, is used in an operation that is performed on a well head. In this system, a further sensor (not shown) may be operatively coupled to a wireline spool or wireline truck that is moving the wireline and associated wireline-connected tool(s) into and out of the well head. The further sensors can determine which direction the wireline spool is rotating and, therefore, provide wireline direction-based information to the user interface. The sensor assembly 600 will provide object-based information based upon the diameter measured of the wireline-connected tool, which is at least partially made up of ferromagnetic materials, as the tool moves towards, through and away from the magnetic field generated by the sensor assembly 600. The direction-based information and the diameter-based information will allow the user to determine when the non-ferromagnetic object has moved out of the wellhead.

Figure 21:
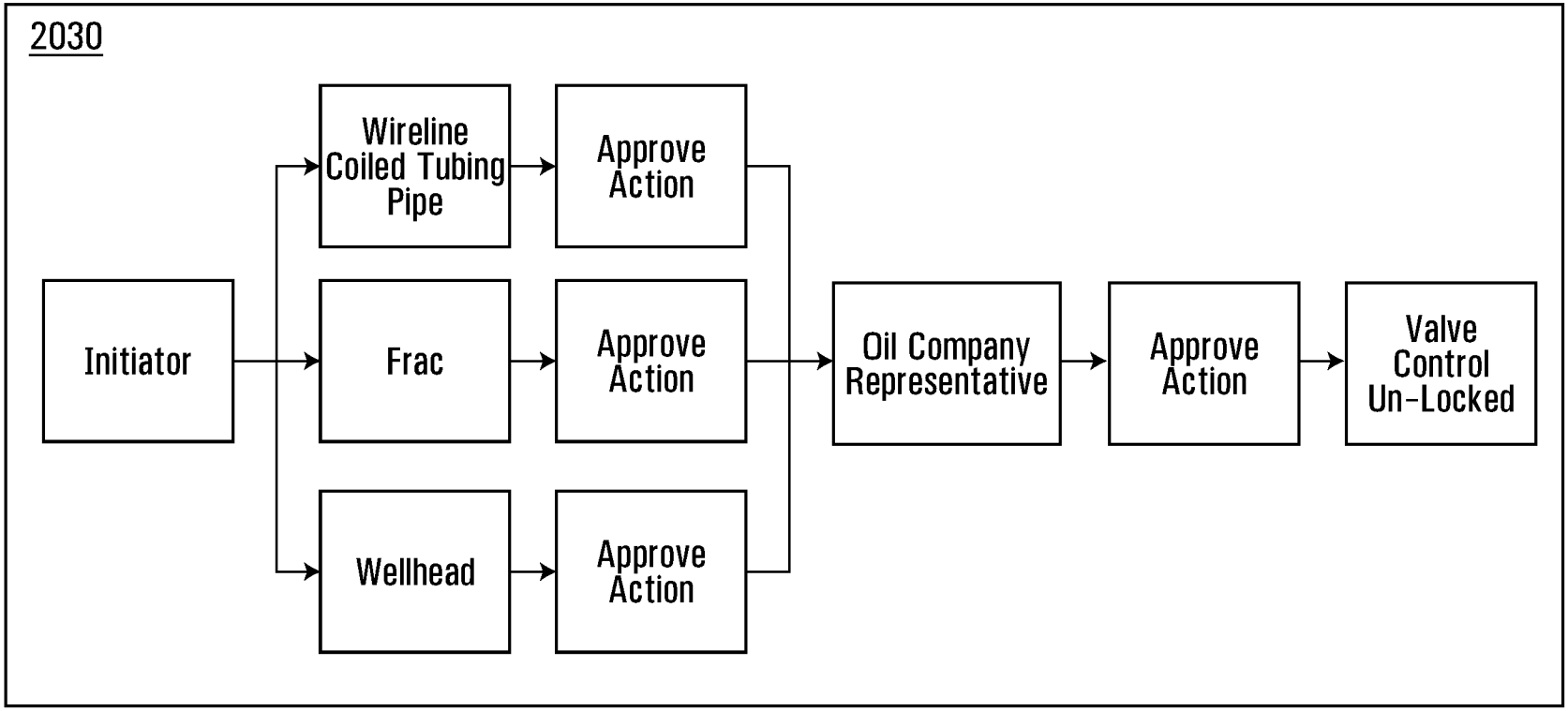
FIG. 21 is a schematic that represents an example of a process that comprises an authority loop, according to embodiments of the present disclosure.

FIG. 21 shows an example of one embodiment of the optional handshake protocol 2030, whereby for the conditions to be met the operator of the wireline, coiled tubing or pipe snubbing unit, the operator of the frac operations and the operator of all valves on the wellhead will all receive an initiator signal. When the initiator signal is received, each of the three operators must approve an action, such as locking or unlocking one or more valves, based upon their operations before any action can be taken. Optionally, when all three operators have approved an action a request for an approval signal may be sent to the oil company consultant, an individual the highest operational authority on the well pad, and that representative may provide the final approval action, which will then allow one or more wellhead control mechanisms to be unlocked and actuated, directly or indirectly.

In some embodiments of the present disclosure, one or more wellhead control mechanisms may include a position sensor that can generate a position-based information signal that is communicated to the controller circuit 3003 and/or the user interface 960. The position-based information signal indicates whether a wellhead control mechanism is open, closed or in a position therebetween. This information can be sent to the controller circuit 3003 and/or to the user interface 690 to provide an operator with valve-position based information. The position sensor can be, but is not limited to: an optical sensor, an ultrasonic sensor; a linear voltage differential transformer; a Hall effect position sensor; a fiber-optic sensor, a capacitive position sensor; an eddy current position sensor; a potentiometric position sensor; a resistance-based position sensor; and, combinations thereof. The position-based information signal is a sub-set of the object-based sensory information.

In some embodiments of the present disclosure, some, most or all of the valve-position regulators within a system described herein above are defaulted to a locked position so that no individual may actuate any wellhead control mechanisms, whether directly or indirectly, without engaging the system and any optional handshake protocols 2030.

As will be appreciated by those skilled in the art, the users on a given well pad may be determined by the types of well operations that are being conducted within a given period of time. While the types and individual users may change over the lifespan of the well pad and the types of users that are contemplated herein include: wireline truck operators, coiled truck operators, frack center operators, wellhead technician, pump down operators, pressure testing operators, pressure control equipment operators, flow-back operators and at least one individual with superior operational authority at the well pad, such as a manager. Each operator of equipment can be a user of the systems of the present disclosure in an effort to improve communication therebetween to avoid actuation of a valve, starting or stopping of fluid flow or object movement through a wellhead when it is not safe based upon operations being conducts upon the wellhead.

The invention claimed is:

1. A wellhead identifier apparatus, the apparatus comprising:

a first part that is mountable to a portion of a wellhead or proximal to the wellhead; and a second part that is mountable to a component of wellhead operation equipment, wherein the component is operatively connectible to the wellhead, wherein the wellhead identifier generates an identifier signal when the first part is proximal the second part and the identifier signal is receivable by a user to identify the wellhead from a plurality of wellheads when the wellhead and the component are operatively connected.

2. The apparatus of claim 1, wherein the first part comprises a sensor for detecting when the second part is proximal the first part.

3. The apparatus of claim 2, wherein the sensor is configured to detect a signature generated by the second part, wherein the signature is a magnetic signature, an electronic signature, a radio-frequency identity signature, an optical signature or any combination thereof.

4. The apparatus of claim 1, wherein the second part comprises a sensor for detecting when the second part is proximal the first part.

5. The apparatus of claim 4, wherein the sensor is configured to detect a signature generated by the first part, wherein the signature is a magnetic signature, an electronic signature, a radio-frequency identity signature, an optical signature or any combination thereof.

6. The apparatus of claim 1, further comprising a transmitter for communicating the identifier signal to a controller circuit.

7. The apparatus of claim 6, wherein the transmitter is configured to communicate the identifier signal wirelessly or by a wire.

8. The apparatus of claim 1, wherein the component is a lubricator.

9. The apparatus of claim 1, wherein the first part is releasably mountable to the portion of the wellhead or proximal to the wellhead.

10. The apparatus of claim 1, wherein the second part is releasably mountable to the component.

11. A wellhead identifier system, the system comprising:

a detectable signal generator mountable to a component of wellhead operation equipment;

a sensor configured to detect the detectable signal for generating object-based sensory information when the wellhead and the component are proximal each other; and a controller circuit for receiving the object-based sensory information and for identifying a wellhead on a well pad wherein the wellhead and the component are operatively connected to each other and where a wellhead operation has or will commence on the wellhead.

12. The system of claim 11, wherein the detectable signal is a pressure signal, an optical signal, a radio-frequency identification signal, an ultrasonic signal, a global positioning information signal, a digital compass signal, a magnetic signal, an electronic signal or any combination thereof.

13. The system of claim 11, wherein the component is a lubricator.

14. The system of claim 13, wherein the controller circuit is further configured to generate a command to prevent actuation of a wellhead control mechanism of the identified wellhead, wherein the command prevents a change in the operational position of the wellhead control mechanism.

* * * * *